US006795978B2

(12) United States Patent
Fournier et al.

(10) Patent No.: US 6,795,978 B2
(45) Date of Patent: Sep. 28, 2004

(54) COLD-WEATHER HELMET WITH SPRING LOADED SUNSHIELD

(75) Inventors: Eric Fournier, Orford (CA); Gilles Basson, Chatillon sur Chalaronne (FR); Louis Guay, Chatillon sur Chalaronne (FR)

(73) Assignee: Bombardier Recreational Products Inc., Saint-Bruno (CA)

( * ) Notice: Subject to any disclaimer, the term of this patent is extended or adjusted under 35 U.S.C. 154(b) by 0 days.

(21) Appl. No.: 10/386,020

(22) Filed: Mar. 12, 2003

(65) Prior Publication Data

US 2004/0000006 A1 Jan. 1, 2004

Related U.S. Application Data

(60) Provisional application No. 60/363,353, filed on Mar. 12, 2002, and provisional application No. 60/410,295, filed on Sep. 13, 2002.

(51) Int. Cl.[7] ..... A42B 1/08

(52) U.S. Cl. ..... 2/424; 2/6.4; 2/6.5; 2/432

(58) Field of Search ..... 2/424, 425, 432, 2/6.3, 6.4, 6.5, 6.7, 10, 12

(56) References Cited

U.S. PATENT DOCUMENTS

| | | | |
|---|---|---|---|
| 1,706,602 | A | 3/1929 | Drager |
| 2,317,608 | A | 4/1943 | Heidbrink |
| 2,348,277 | A | 5/1944 | Boothby et al. |
| 2,867,812 | A | 1/1959 | Roth et al. |
| 3,065,747 | A | 11/1962 | Forkel |
| 3,110,034 | A | 11/1963 | Aileo |
| 3,237,202 | A | 3/1966 | Aileo |
| 3,239,843 | A | 3/1966 | Lobelle |
| 3,310,811 | A | 3/1967 | Iacono, Jr. |
| 3,351,056 | A | 11/1967 | Durney |
| 3,400,407 | A | 9/1968 | Aileo |
| 3,721,994 | A | 3/1973 | DeSimone et al. |
| 3,833,935 | A | 9/1974 | Ansite et al. |
| 3,971,368 | A | 7/1976 | Forbes et al. |

(List continued on next page.)

FOREIGN PATENT DOCUMENTS

| | | |
|---|---|---|
| CA | 2065300 | 8/1990 |
| DE | 2608626 A1 * | 9/1977 |

(List continued on next page.)

OTHER PUBLICATIONS

Search Report for European Patent Application No. 01130658.6–2314 dated May 10, 2002.

(List continued on next page.)

*Primary Examiner*—Rodney M. Lindsey
(74) *Attorney, Agent, or Firm*—BRP Legal Services

(57) ABSTRACT

A helmet is particularly well suited for cold-weather use. The helmet includes a jaw shield that is detachable from a head portion. A breathing mask connects to the jaw shield via a mask adjustment mechanism that selectively axially moves the breathing mask toward and away from an inner surface of the jaw shield to precisely and accurately position the breathing mask against the nose and mouth of the helmet's wearer. A spring-loaded quick-release tinted shield is controlled by a lever that selectively raises and lowers the tinted shield. An eye shield pivotally connects to the helmet and is disposed in front of the tinted shield. An eye shield heating system on the eye shield electrically connects to the head portion of the helmet to provide electric power to the heating system.

27 Claims, 31 Drawing Sheets

U.S. PATENT DOCUMENTS

| | | | | | |
|---|---|---|---|---|---|
| 4,170,042 | A | | 10/1979 | Aileo | |
| 4,315,335 | A | | 2/1982 | Kennedy, Jr. | |
| 4,514,864 | A | | 5/1985 | Huber | |
| 4,555,815 | A | | 12/1985 | Walther | |
| 4,556,994 | A | | 12/1985 | Kawasaki et al. | |
| 4,579,113 | A | | 4/1986 | McCreadie et al. | |
| 4,595,003 | A | | 6/1986 | Shoemaker et al. | |
| 4,598,430 | A | | 7/1986 | Nava | |
| 4,612,675 | A | * | 9/1986 | Broersma | 2/424 |
| 4,667,348 | A | | 5/1987 | Sundahl | |
| 4,676,236 | A | | 6/1987 | Piorkowski et al. | |
| 4,689,836 | A | | 9/1987 | Vitaloni | |
| 4,704,746 | A | | 11/1987 | Nava | |
| 4,734,940 | A | | 4/1988 | Galet et al. | |
| 4,764,990 | A | | 8/1988 | Markert | |
| 4,794,652 | A | | 1/1989 | Piech von Planta et al. | |
| 4,803,980 | A | | 2/1989 | Nowakowski et al. | |
| 4,807,305 | A | * | 2/1989 | Sundahl | 2/424 |
| 4,886,056 | A | | 12/1989 | Simpson | |
| 4,907,300 | A | | 3/1990 | Dampney et al. | |
| D312,513 | S | | 11/1990 | Morin | |
| 5,003,632 | A | | 4/1991 | Claude | |
| 5,078,130 | A | | 1/1992 | Van Oosten et al. | |
| 5,093,939 | A | | 3/1992 | Noyerie et al. | |
| H1039 | H | | 4/1992 | Tripp, Jr. et al. | |
| 5,148,550 | A | | 9/1992 | Hodgkinson et al. | |
| D331,299 | S | | 11/1992 | Kamata | |
| 5,187,502 | A | | 2/1993 | Howell | |
| D334,250 | S | | 3/1993 | Gallet | |
| D340,545 | S | | 10/1993 | Kamata | |
| D340,546 | S | | 10/1993 | Kamata | |
| 5,254,852 | A | * | 10/1993 | Filipovich et al. | 250/214 VT |
| 5,291,880 | A | | 3/1994 | Almovist et al. | |
| D351,685 | S | | 10/1994 | Kamata | |
| 5,394,566 | A | | 3/1995 | Hong | |
| 5,396,661 | A | | 3/1995 | Sutter et al. | |
| D361,867 | S | | 8/1995 | Taniuchi | |
| 5,444,875 | A | | 8/1995 | Taniuchi | |
| 5,500,953 | A | * | 3/1996 | Reuber et al. | 2/9 |
| 5,515,843 | A | | 5/1996 | Chang | |
| 5,538,001 | A | | 7/1996 | Bridges | |
| 5,549,104 | A | | 8/1996 | Crump et al. | |
| 5,555,569 | A | | 9/1996 | Lane | |
| 5,584,073 | A | | 12/1996 | Radzelovage et al. | |
| 5,603,317 | A | | 2/1997 | Farmer | |
| 5,619,755 | A | | 4/1997 | Casartelli | |
| 5,630,412 | A | | 5/1997 | Dubruille et al. | |
| 5,649,532 | A | | 7/1997 | Griffiths | |
| 5,653,225 | A | | 8/1997 | Schegerin | |
| 5,680,656 | A | | 10/1997 | Gath | |
| 5,694,650 | A | * | 12/1997 | Hong | 2/424 |
| 5,722,091 | A | | 3/1998 | Keller et al. | |
| 5,758,639 | A | | 6/1998 | Ikonen | |
| 5,765,235 | A | | 6/1998 | Arnold | |
| 5,794,260 | A | | 8/1998 | Schegerin | |
| 5,797,146 | A | | 8/1998 | Matich | |
| 5,901,369 | A | | 5/1999 | Pilney | |
| D411,900 | S | | 7/1999 | Puleo | |
| 5,924,420 | A | | 7/1999 | Reischel et al. | |
| D418,255 | S | | 12/1999 | Hohdorf | |
| 6,047,409 | A | | 4/2000 | Simpson | |
| 6,085,358 | A | | 7/2000 | Cogan | |
| 6,161,225 | A | | 12/2000 | Arai | |
| 6,249,918 | B1 | | 6/2001 | Lacroix | |
| 6,425,143 | B1 | | 7/2002 | Benedict et al. | |
| 6,644,308 | B2 | * | 11/2003 | Kalhok et al. | 128/201.24 |
| 2002/0104533 | A1 | | 8/2002 | Kalhok et al. | |

FOREIGN PATENT DOCUMENTS

| | | | | | |
|---|---|---|---|---|---|
| DE | 2 846 636 | | | 4/1980 | |
| DE | 4 416 921 | A1 | | 11/1995 | |
| EP | 0 259 269 | | | 3/1988 | |
| EP | 0 270 368 | B1 | | 6/1988 | |
| EP | 0 371 858 | A1 | | 6/1990 | |
| EP | 481860 | A1 | * | 4/1992 | A42B/3/22 |
| EP | 0 498 099 | A1 | | 8/1992 | |
| EP | 0 590 255 | | | 4/1994 | |
| EP | 0 638 253 | | | 2/1995 | |
| FR | 2 413 892 | | | 9/1979 | |
| FR | 2413892 | A | * | 9/1979 | A42B/3/02 |
| FR | 2 593 035 | | | 7/1987 | |
| FR | 2626149 | A1 | * | 7/1989 | A42B/3/02 |
| FR | 2 706 257 | | | 12/1994 | |
| FR | 2 773 051 | | | 9/2001 | |
| GB | 2 052 244 | | | 1/1981 | |
| WO | WO 94/05175 | | | 3/1994 | |
| WO | 94/05175 | | | 3/1994 | |
| WO | WO 95/28100 | | | 10/1995 | |
| WO | WO 99/27999 | | | 6/1999 | |
| WO | WO 99/62365 | | | 12/1999 | |

OTHER PUBLICATIONS

BMW Owners News, Heard It Through the Grapevine, by Sandy Cohen, Mar. 2001.

Lazer Helmet Advertisement, Snow Sports, Season 2001 (believed to be Mar. 2001), including 4 photos of the Lazar Helmet depicted in the Advertisement.

International Search Report, PCT/CA03/00365, Jun. 13, 2003.

International Search Report, PCT/CA03/00366, Jul. 14, 2003.

International Search Report, PCT/CA03/00367, Jul. 14, 2003.

* cited by examiner

COLD-WEATHER HELMET WITH SPRING LOADED SUNSHIELD

CROSS-REFERENCE

This application claims the benefit of priority to U.S. Provisional Patent Application No. 60/363,353, titled "COLD-WEATHER HELMET," filed on Mar. 12, 2002, and U.S. Provisional Patent Application No. 60/410,295, titled "COLD-WEATHER HELMET," filed on Sep. 13, 2002, both of which are incorporated herein by reference.

BACKGROUND OF THE INVENTION

1. Field of the Invention

The invention relates to a helmet that is particularly well suited for cold-weather use.

2. Description of Related Art

A prior art helmet comprises a head portion that protects the head of a wearer, as a conventional helmet; a jaw shield, which is integrated with and forms a projection with the head portion and protects the lower part of the face of the wearer, more particularly the jaw; and an eye shield, which is situated between an upper front section of the head portion and an upper section of the jaw shield to protect the face of the wearer.

Due to its structure, the helmet has a small interior chamber. This interior chamber is usually insulated from the atmosphere to protect the wearer from cold air. At a certain temperature, water vapor in the humid air exhaled by the wearer will create condensation. Because the temperature of the lens of the eyeglasses of the operator wearing the helmet or the eye shield of the helmet can reach the condensation point of the breath of the wearer, water and/or ice will form on the eyeglass lens or on the eye shield.

To avoid the problem of condensation, it is possible to open the shield to allow outside air to flow into the helmet until the condensation is eliminated. This, however, presents a problem in that the wearer may be exposed to cold air, which is uncomfortable at the very least. Furthermore, the wearer has to use one hand to open the shield, which may be awkward when he or she is steering the vehicle being driven. The shield could also involuntarily close as a result of a sudden movement, which is potentially distracting. Thus, there is a need to provide a device which is capable of avoiding or eliminating the condensation created inside a full face helmet. There is a further need to provide such a device with an adjustment mechanism that can be manipulated by a wearer who is wearing gloves to protect his/her hands from the cold environment.

Prior art helmets provide some protection against the sun's rays. However, the shield of prior art helmets is either clear or tinted and adjustment of the tint is usually not possible. On a bright sunny day, the wearer of a prior art helmet also must wear tinted eyeglasses to protect himself against the intensity of light, if the shield of his helmet is clear. In changing weather conditions, the wearer may have to remove and/or replace his tinted eyeglasses (or sunglasses) as the intensity of light changes. Thus, a need has developed for a helmet with an adjustable tinted shield. Because, as discussed above, the helmet wearer typically will wear both gloves and a helmet in a cold environment, there is a need to provide a tinted shield adjustment mechanism that can be controlled by the wearer while the wearer is wearing gloves.

Helmets that are adapted for cold-weather use are commonly equipped with electrically-heated eye shields that prevent water vapor from condensing and/or freezing on the eye shield. U.S. Pat. Nos. 5,694,650 and 5,500,953 illustrate two examples of such heated eye shields. In each, an electric heating element extends across the eye shield, which is pivotally or otherwise movably connected to the helmet. The eye shield includes an electric connector that connects to an external power supply via power supply leads. If the wearer is riding a snowmobile, the power supply is typically the snowmobile's battery. In these conventional heated eye shields, the power supply leads act as tethers between the eye shield and the power source and tend to disadvantageously move the heated eye shield during use. There is therefore a need to provide an electrical connection between a heated eye shield and an external power source that does not tend to move the eye shield relative to the helmet.

U.S. patent application Ser. No. 10/075,992, which published on Aug. 8, 2002 as U.S. 2002/0104533 A1 and is incorporated by reference herein, discloses another conventional helmet. The helmet comprises a head portion, a shield portion, and a breathing mask. The shield portion comprises a jaw shield and an eye shield. The jaw shield is pivotally connected to the head portion and can be pivoted downwardly into a closed position and upwardly into an open position. The eye shield is pivotally connected to the head portion and includes a see-through shield and a tinted shield. The tinted shield is pivotally connected to the eye shield and can be lowered inside the helmet to protect the wearer from sun rays and raised into an upper, enclosed portion of the eye shield. The breathing mask is hermetically adapted to the face of the wearer to evacuate the wearer's breath outside the helmet through breathing channels that extend laterally outwardly and rearwardly through the jaw shield.

In summary, there are several deficiencies in prior art helmets that necessitate an improved helmet design. This is especially true for the design of helmets specifically intended for cold weather use, such as for snowmobiling or the like.

SUMMARY OF THE INVENTION

One aspect of one or more embodiments of the present invention provides an improved cold-weather helmet that includes a variety of features that simplify and improve the helmet's ability to function effectively in cold weather.

An additional aspect of one or more embodiments of the present invention provides a helmet with features that can be easily controlled using a gloved hand.

A further aspect of one or more embodiments of the present invention provides a helmet with an easily adjustable breathing mask.

A further aspect of one or more embodiments of the present invention provides a helmet with a detachable jaw shield.

A further aspect of one or more embodiments of the present invention provides a helmet with a heated eye shield with a power source lead that does not interfere with the driver's positioning of the eye shield.

A further aspect of one or more embodiments of the present invention provides a helmet with an easily adjustable tinted shield.

A further aspect of one or more embodiments of the present invention provides a helmet that includes a head portion. An eye shield connects to the head portion for relative movement between a raised position such that the eye shield is substantially out of a wearer's field of vision and at least one lowered position wherein the eye shield is disposed in front of the wearer's eyes. A tinted shield is disposed behind the eye shield, the tinted shield being connected to the head portion and being moveable between a raised position wherein the tinted shield is substantially out of the wearer's field of vision and at least one lowered position wherein the tinted shield is disposed in front of the wearer's eyes. A resilient member connects between the head portion and the tinted shield. The resilient member biases the tinted shield toward the raised position.

According to a further aspect of one or more of these embodiments, the helmet further includes a holding device operatively connecting the eye shield to the tinted shield. The holding device selectively prevents the tinted shield from moving from the lowered position to the raised position when the tinted shield and the eye shield are in the lowered positions.

According to a further aspect of one or more of these embodiments, the holding device further includes a lever connected to the holding device, the lever being displaceable in lowering and raising directions, the lever moving the tinted shield into a lowered position when the lever is moved in the lowering direction.

According to a further aspect of one or more of these embodiments, the lever is adapted to disengage the holding device from the eye shield when the eye shield and the tinted shield are in the lowered position, thereby allowing the tinted shield to move into the raised position when the lever is moved in the raising direction.

According to a further aspect of one or more of these embodiments, the tinted shield is connected to the head portion for pivotal movement about a first axis. According to a further aspect of one or more of these embodiments, the eye shield is connected to the head portion for pivotal movement about a second axis.

According to a further aspect of one or more of these embodiments, the lever is flexible along a direction of the first axis.

According to a further aspect of one or more of these embodiments, the eye shield includes a block mounted on an inside surface thereof The block abuts the lever when the eye shield and the tinted shield are in the lowered position thus preventing the tinted shield from returning to the raised position.

A further aspect of one or more embodiments of the present invention provides a helmet that includes a head portion, an eye shield connected to the head portion moveable between a raised position where the eye shield is substantially out of a wearer's field of vision and at least one lowered position where the eye shield is disposed in front of the wearer's eyes, and a tinted shield behind the eye shield. The tinted shield connects to the head portion and is moveable between a raised position where the tinted shield is substantially out of the wearer's field of vision and at least one lowered position where the tinted shield is disposed in front of the wearer's eyes. The helmet further includes a first resilient member connected between the head portion and the tinted shield, the first resilient member biasing the tinted shield toward the raised position. A holding device is disposed between the head portion and the tinted shield, the holding device selectively preventing relative movement between the tinted shield and the head portion when the tinted shield is in a lowered position.

According to a further aspect of one or more of these embodiments, the helmet further includes a lever connected to the head portion. The lever is displaceable in lowering and raising directions. The lever releases the holding device thereby allowing the tinted shield to move into the raised position when the lever is moved in the raising direction. The lever engages the tinted shield and moves the tinted shield into a lowered position when the lever is moved in the lowering direction.

According to a further aspect of one or more of these embodiments, the tinted shield is connected to the head portion for pivotal movement about a first axis. According to a further aspect of one or more of these embodiments, the lever is connected to the head portion for pivotal movement between the raising and lowering directions about a second axis that is offset from the first axis.

According to a further aspect of one or more of these embodiments, the holding device includes a first at least one tooth mounted to the tinted shield, and a second at least one tooth mounted to the head portion. The first at least one tooth and second at least one tooth are positioned to engage each other when the tinted shield is moved into the lowered position, thereby discouraging the tinted shield from moving into the raised position under the biasing force of the first resilient member.

According to a further aspect of one or more of these embodiments, the first at least one tooth includes a first plurality of teeth, the second at least one tooth includes a second plurality of teeth, and the tinted shield has a plurality of lowered positions corresponding to one of each of the first and second plurality of teeth.

According to a further aspect of one or more of these embodiments, the helmet further includes a lever connected to the head portion. The lever is displaceable in lowering and raising directions. The lever releases the first at least one tooth from the second at least one tooth thereby allowing the tinted shield to move into the raised position when the lever is moved in the raising direction. The lever engages the tinted shield and moves the tinted shield into a lowered position when the lever is moved in the lowering direction.

According to a further aspect of one or more of these embodiments, the helmet further includes a second resilient member connected between the lever and the head portion, the second resilient member biasing the lever in a neutral position.

According to a further aspect of one or more of these embodiments, the lever further includes a lowering hole, and the tinted shield further includes a lowering protrusion which engages with the lowering hole when the lever is moved in the lowering direction to move the tined shield into a lowered position.

According to a further aspect of one or more of these embodiments, the lever further includes a raising wedge which releases the first at least one tooth from the second at least one tooth when the lever is moved in the raising direction.

According to a further aspect of one or more of these embodiments, the lever further includes a handle. The handle is pulled to rotate the lever altering the position of the lowering hole thus causing the lowering hole to engage the lowering protrusion pulling the tinted shield toward the lowered position. The handle is pushed to rotate the lever, which forces the raising wedge between the first at least one tooth and the second at least one tooth to allow the tinted shield to rotate toward a raised position under the force of the first resilient member.

According to a further aspect of one or more of these embodiments, the lever further includes a handle. The handle is pulled to rotate the lever altering the position of the lowering hole thus causing the lowering hole to engage the lowering protrusion pulling the tinted shield toward the lowered position. The handle is pushed to rotate the lever, which forces the raising wedge between the first at least one tooth and the second at least one tooth to allow the tinted shield to rotate toward a raised position under the force of the first resilient member.

According to a further aspect of one or more of these embodiments, the tinted shield is connected to the head portion for pivotal movement about a first axis. According to a further aspect of one or more of these embodiments, the lever is connected to the head portion for pivotal movement between the raising and lowering directions about a second axis that is offset from the first axis.

According to a further aspect of one or more of these embodiments, the helmet further includes a bumper which cushions the impact force of the raising tinted shield when the tinted shield is thrust upwardly under the biasing force of the first resilient member.

According to a further aspect of one or more of these embodiments, the lowering hole includes a lowering edge such that the lowering edge does not contact the lowering protrusion when the lever is pushed to rotate the lever which forces the raising wedge between the first at least one tooth and the second at least one tooth to allow the tinted shield to rotate toward a raised position under the force of the first resilient member.

According to a further aspect of one or more of these embodiments, the helmet further includes a right side and a left side, the handle being placed on one of the right side and the left side of the helmet.

According to a further aspect of one or more of these embodiments, the handle is adapted to be grasped by one hand of a user wearing the helmet.

Additional and/or alternative objects, features, and advantages of the embodiments of the present invention will become apparent from the following description, the accompanying drawings, and the appended claims.

BRIEF DESCRIPTION OF THE DRAWINGS

For a better understanding of the present invention as well as other objects and further features thereof, reference is made to the following description which is to be used in conjunction with the accompanying drawings, where.

DETAILED DESCRIPTION OF PREFERRED EMBODIMENTS OF THE INVENTION

Before delving into the specific details of the present invention, it should be noted that the conventions "left,"

"right," "front," "rear," "up," and "down" are defined relative to the head of a wearer of a helmet. For example, a "forward" direction is the direction in which the wearer looks while wearing a helmet.

Figure 1:
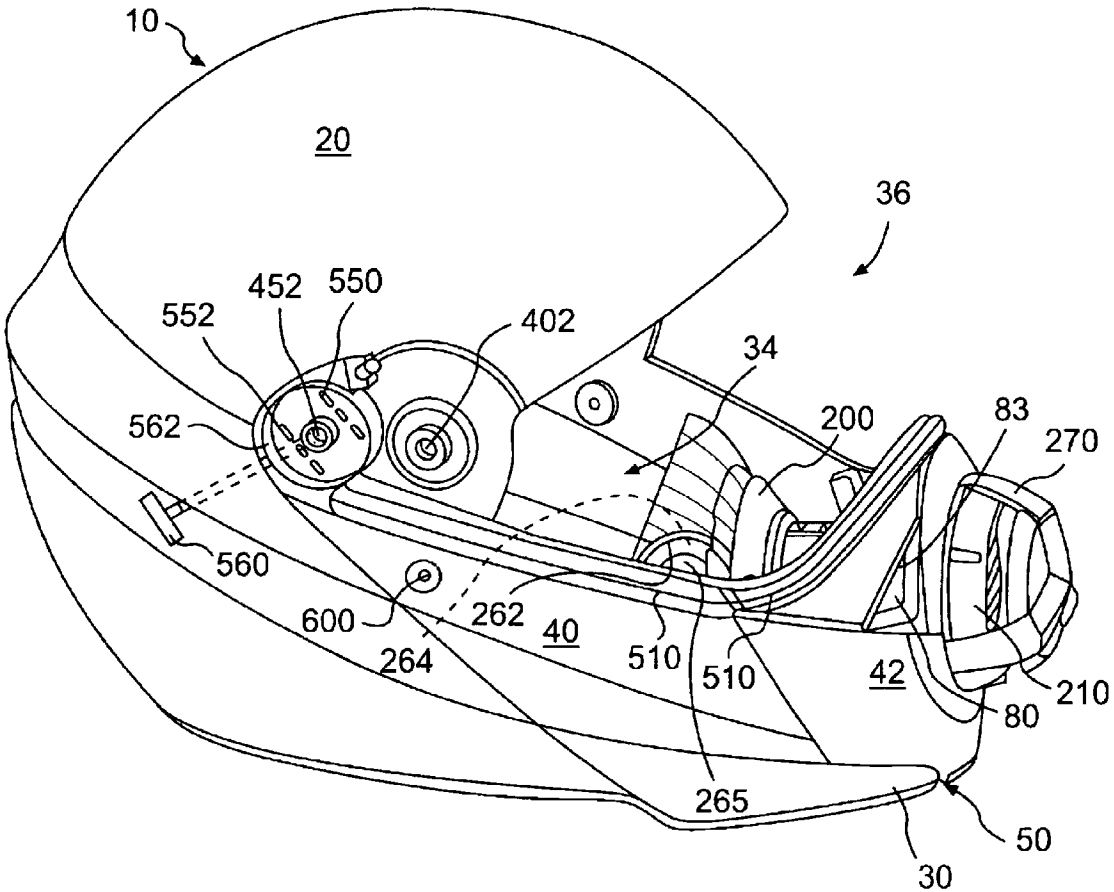
FIG. 1 is a right side view of a helmet according to one embodiment of the present invention with a tinted shield and eye shield removed.

FIG. 1 is a side view of a helmet 10 according to the present invention. The helmet 10 includes a head portion 20 that is adapted to protect a majority of the wearer's head. A jaw shield 30 connects to a lower forward portion of the head portion 20. The head portion 20 and jaw shield 30 together define an inner space 34 that is shaped to accommodate the head of the wearer. The inner space 34 opens to the exterior of the helmet 10 at a semi-crescent-shaped opening 36 in front of the wearer's eyes when the wearer wears the helmet 10. The opening 36 is defined between a forward edge of the head portion 20 and an upper edge of the jaw shield 30.

Figure 2:
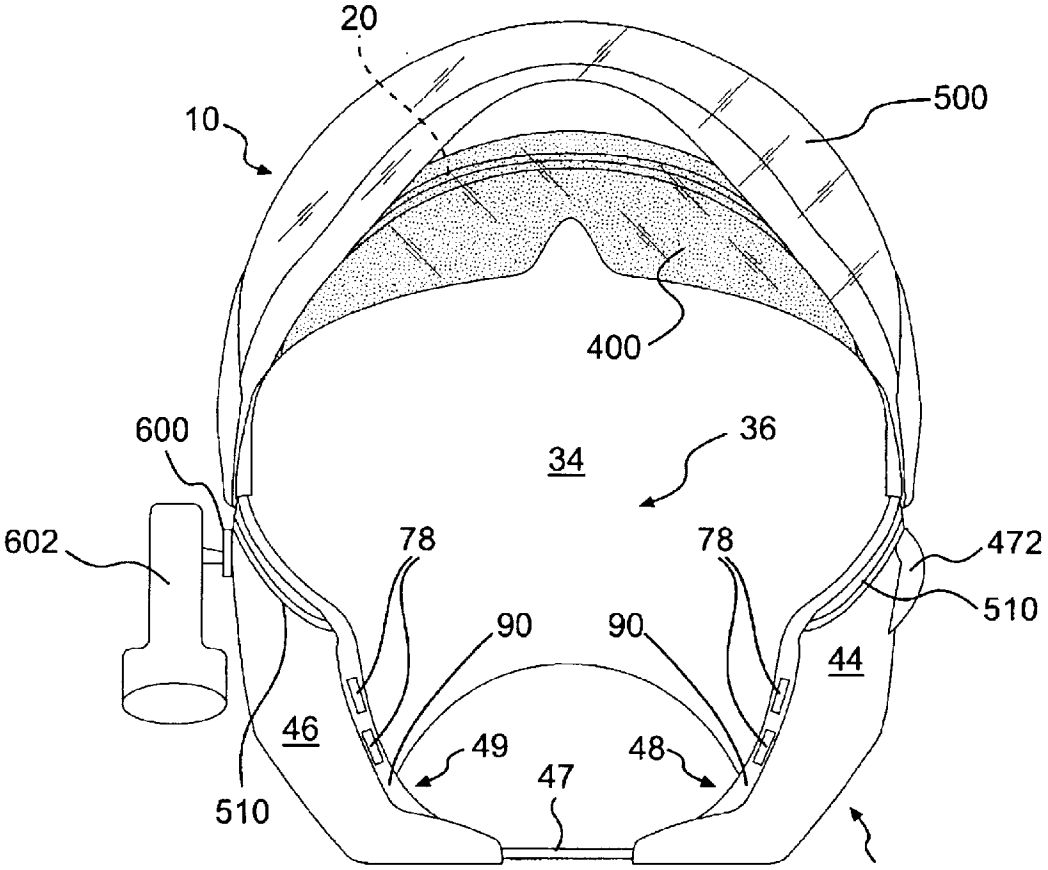
FIG. 2 is a front view of the helmet of FIG. 1 with the detachable jaw shield removed.
Figure 3:
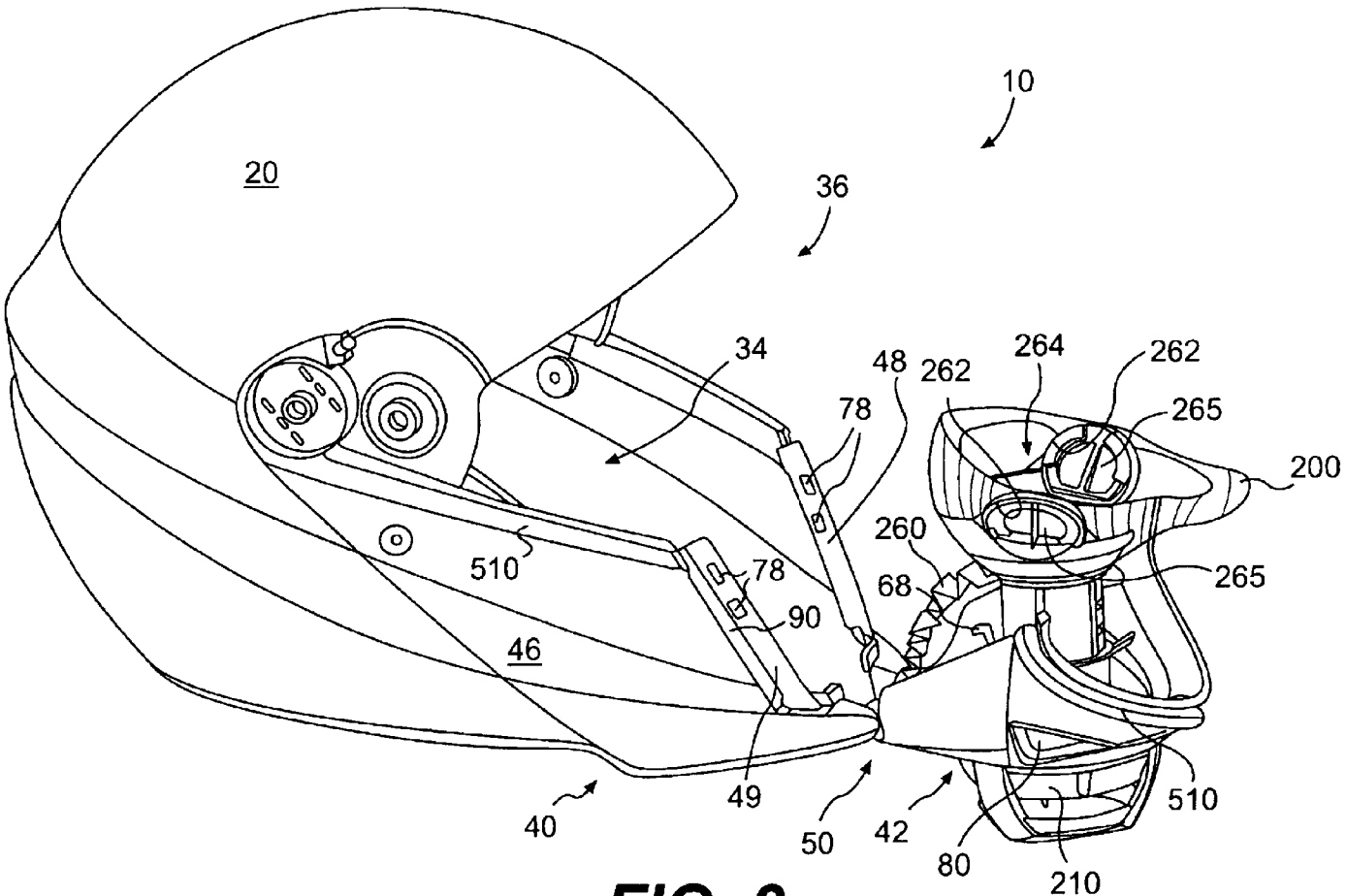
FIG. 3 is right side view of the helmet of FIG. 1 with the detachable jaw shield partially removed and the tinted shield and eye shield fully removed.

As illustrated in FIGS. 1–3, the jaw shield 30 includes a fixed portion 40 and a detachable portion 42. Referring to FIG. 2, the fixed portion 40 includes left and right sides/portions 44, 46 that extend forwardly and laterally inwardly toward each other from left and right forward lower sides, respectively, of the head portion 20. The sides 44, 46 of the fixed portion 40 generally from a convex arc around the inner space 34. In the illustrated embodiment, the sides 44, 46 are integrally formed with the head portion 20. However, the sides 44, 46 may alternatively be formed separately from the head portion 20 and then rigidly attached to the head portion 20. As illustrated in FIG. 2, a laterally-extending pin 47 extends between lower portions of the left and right forward, inner sides 48, 49 of the left and right portions 44, 46 of the fixed portion 40.

A detachable portion 42 receiving opening is defined between the inner sides 48, 49, an upper edge of the pin 47, and a lower edge of the semi-crescent-shaped opening 36. The receiving opening is adapted to be disposed generally in front of a mouth and nose of the wearer of the helmet 10.

The detachable portion 42 has an attached position (see FIG. 1) where the detachable portion 42 is rigidly held at a lower, front, middle portion of the helmet 10 (i.e., in the receiving opening for the detachable portion 42). The detachable portion 42 also has a detached position in which the detachable portion 42 is not rigidly attached to the helmet 10 (see FIGS. 2, 4). However, even in the detached position, the detachable portion 42 may be tethered to the rest of the helmet 10 via a tether cord (not shown).

The detachable portion 42 is selectively attached to the fixed portion 40 using a separable hinge 50 and a latch mechanism 52. Details of the latch mechanism 52 are provided in FIG. 5.

The separable hinge 50 includes two parts. One part is defined by the pin 47, which preferably has a round cross-section. The other part is a C-shaped clip 56 that is attached to a lower, laterally-centered portion of the detachable portion 42 (see FIG. 5). The clip 56 extends laterally along the detachable portion 42 over a width that preferably generally corresponds to an exposed laterally-extending length of the pin 47. The cross-section of the clip 56, as it extends laterally, is defined by the C-shape. The opening of the "C" preferably aims generally forwardly and slightly downwardly when the detachable portion 42 is in the attached position.

While in the illustrated embodiment, the pin 47 is disposed on the fixed portion 40 and the C-shaped clip 56 is disposed on the detachable portion 42, the relative positions of the pin 47 and clip 56 may be interposed without deviating from the scope of the present invention. Furthermore, because other types of separable hinges may also be used, the present invention is not limited to the hinge 50 described.

As best illustrated in FIG. 3, to engage the two parts of the separable hinge 50, the detachable portion 42 is aimed forwardly and downwardly in front of the fixed portion 40. The clip 56 is moved downwardly such that the C-shape engages the pin 47. The detachable portion 42 can thereafter be pivoted upwardly and rearwardly toward the inner space 34 about a pivot axis defined by the pin 47. When the detachable portion 42 is pivoted fully into its attached position, the latch mechanism 52 automatically rigidly engages upper portions of the fixed and detachable portions 40, 42 to prevent the detachable portion 42 from pivoting away from the fixed portion 40. The engagement between the outer lateral sides of the detachable portion 42 and the sides 48, 49 of the fixed portion 40 prevents the C-shaped clip 56 from moving rearwardly relative to the pin 47, thereby preventing the separable hinge 50 from separating.

In the illustrated embodiment, the sides 48, 49 and pin 47 of the fixed portion 40 generally form a U shape. The lower edge of the detachable portion 42 also forms a U shape that mates with the U shape of the sides 48, 49 and pin 47. Alternatively, the intersection between the fixed and detachable portions 40, 42 may take on a variety of other shapes (see, e.g., the embodiment illustrated in FIGS. 13–21).

Figure 4:
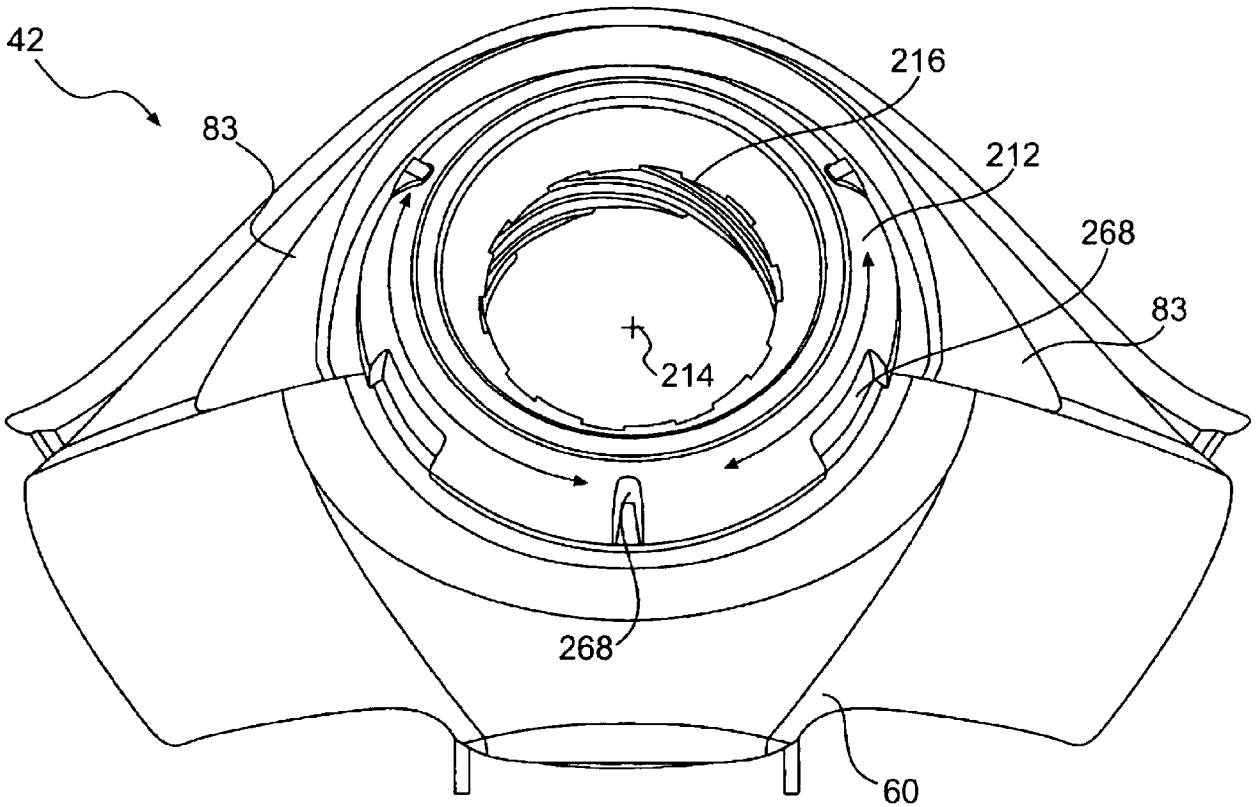
FIG. 4 is a front view of the detachable jaw shield of the helmet of FIG. 1.
Figure 5:
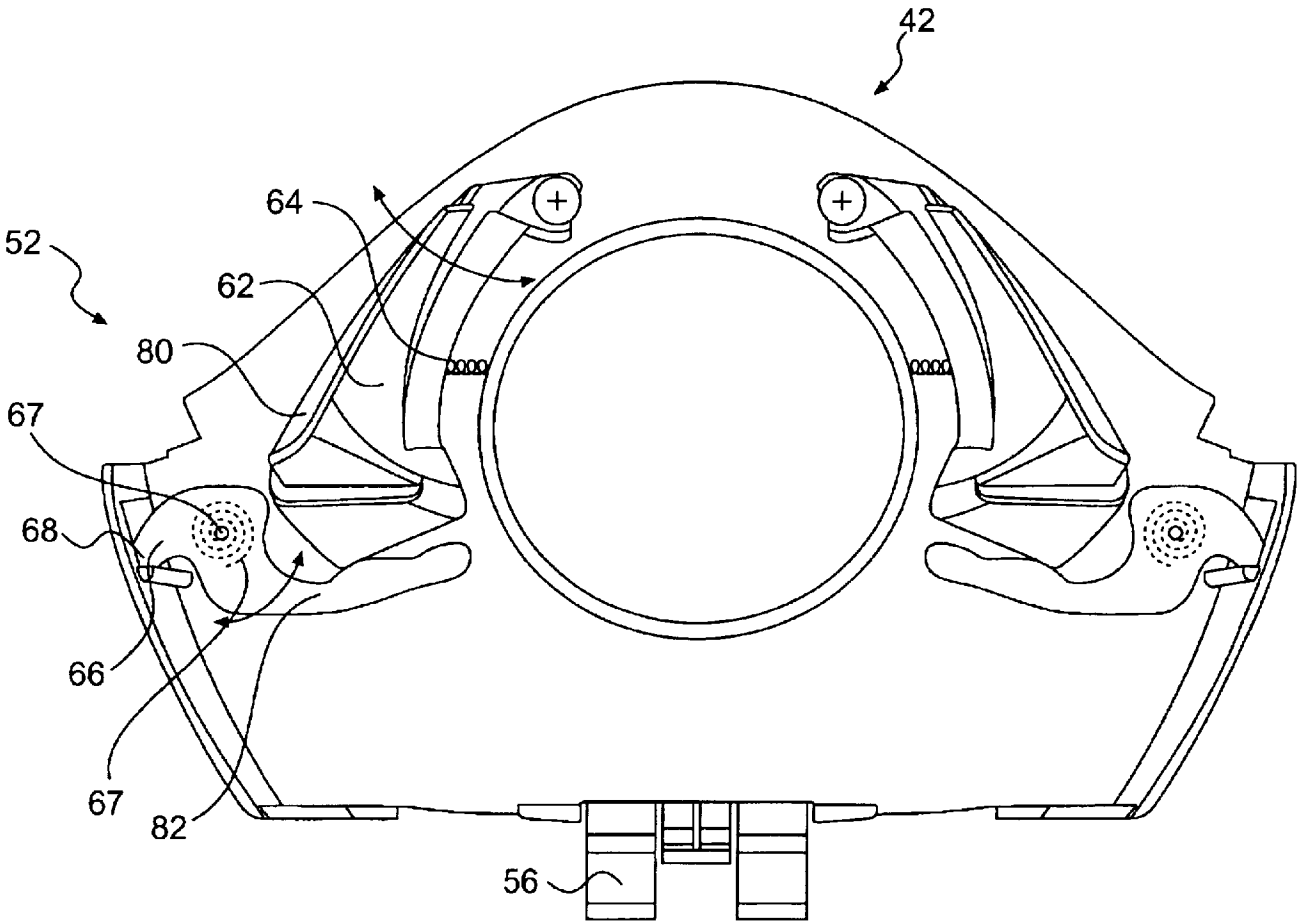
FIG. 5 is a front view of the detachable jaw shield of the helmet of FIG. 1 with the cover removed.

The latch mechanism 52 will now be described with reference to FIGS. 2 and 5. FIG. 5 is a partial front view of the detachable portion 42 with a front cover 60 (see FIGS. 4 and 6) removed. The two lateral sides of the latch mechanism 52 are mirror images of each other in the embodiment shown. Accordingly, only the left side will be described because the description applies to the right side as well. The left side of the latch mechanism 52 includes a lever 62 that is pivotally connected to the detachable portion 42 so that the lever 62 may move in the direction indicated by the arrows. A resilient member (i.e., a spring, etc.) 64 extends between the lever 62 and the detachable portion 42 to bias the lever 62 laterally outwardly (clockwise as shown in FIG. 5). A hook arm 66 is pivotally connected to the detachable portion 42 about a generally horizontal axis so that the hook arm 66 may move in the directions indicated by the arrows. A resilient member 67 (i.e., a torsion spring, a tension spring, etc.) extends between the hook arm 66 and the detachable portion 42 to bias a downwardly-pointing hook 68, which is formed at a laterally outward and rearward end of the hook arm 66, downwardly into an engaged position (counterclockwise as shown in FIG. 5). The hook 68 is generally disposed at an upper, rearward, laterally-outward end of the detachable portion 42.

As illustrated in FIG. 2, the latch mechanism 52 further includes a slot (or catch plate) 78 disposed at an upper end of the inner side 48 of the left portion 44 (and of the right portion 46) of the fixed portion 40.

To engage the latch mechanism 52, the separable hinge 50 is engaged and the detachable portion 42 is rotated upwardly toward the inner space 34. The hooks 68 abut lower edges of the slots 78 when the detachable portion 42 is rotated almost fully upwardly. The abutting contact pushes the hooks 68 upwardly against the biasing force of the resilient members 67, thereby allowing the hooks 68 to pass into the slots 78. The hooks 68 thereafter rotate downwardly, under the biasing force of the resilient members 67, to engage the slots 78 and rigidly hold the detachable portion 42 against the fixed portion 40 when in the attached position.

To release the latch mechanism 52, the wearer depresses two triangularly-shaped protrusions 80 on the levers 62 laterally-inwardly. The levers 62 and protrusions 80 are positioned to enable a wearer to depress both levers 62 laterally inwardly by squeezing the protrusions 80 together with a single hand. The resulting inward lateral movement of the levers 62 causes the levers 62 to engage second arms 82 on the hook arms 66, thereby rotating the hook arms 66 and hooks 68 upwardly into a disengaged position relative to the slots 78. The detachable portion 42 can thereafter be freely rotated outwardly and downwardly away from the inner space 34 to allow the wearer to separate the separable hinge 50 and detach the detachable portion 42 from the fixed portion 40.

Because the latch mechanism 52 includes two independently operating hooks 68, the accidental actuation of just one of the hooks 68 will not release the latch mechanism 52. This safety feature prevents the latch mechanism 52 from accidentally releasing during use of the helmet 10.

Figure 6:
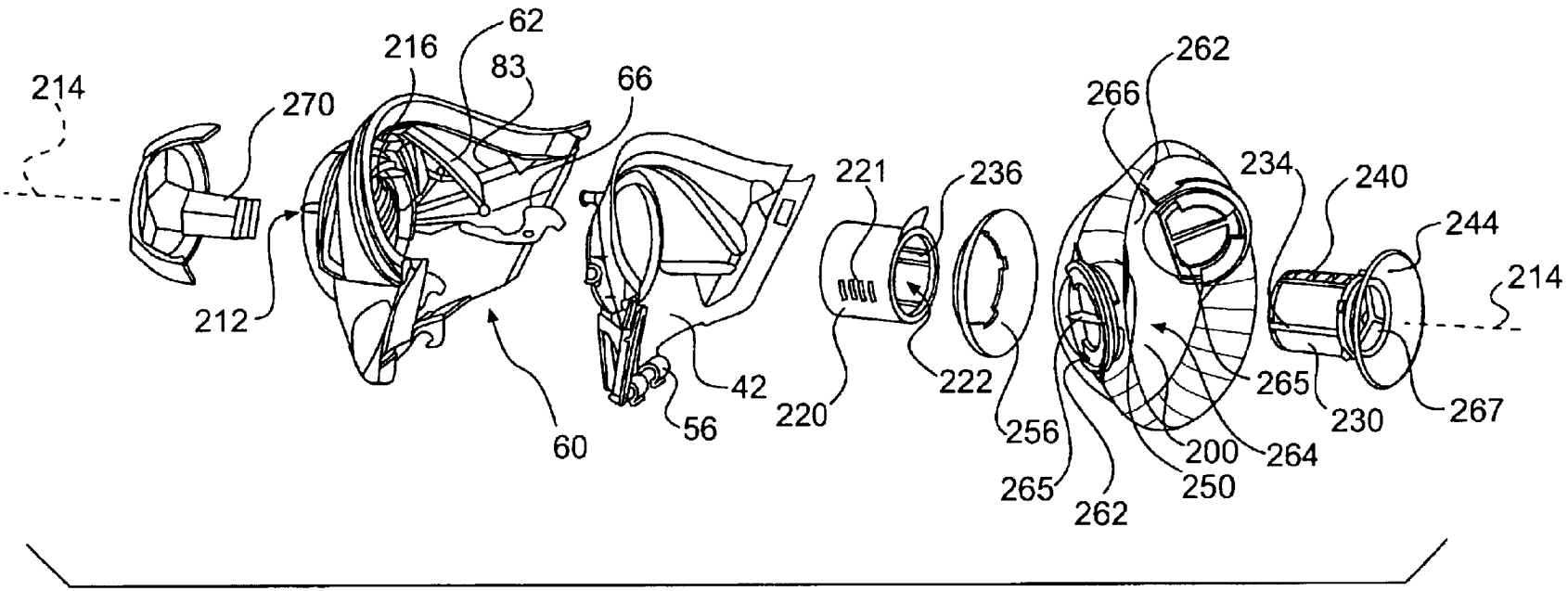
FIG. 6 is an exploded view of the detachable jaw shield, breathing mask, and mask adjustment mechanism of the helmet of FIG. 1.
Figure 7:
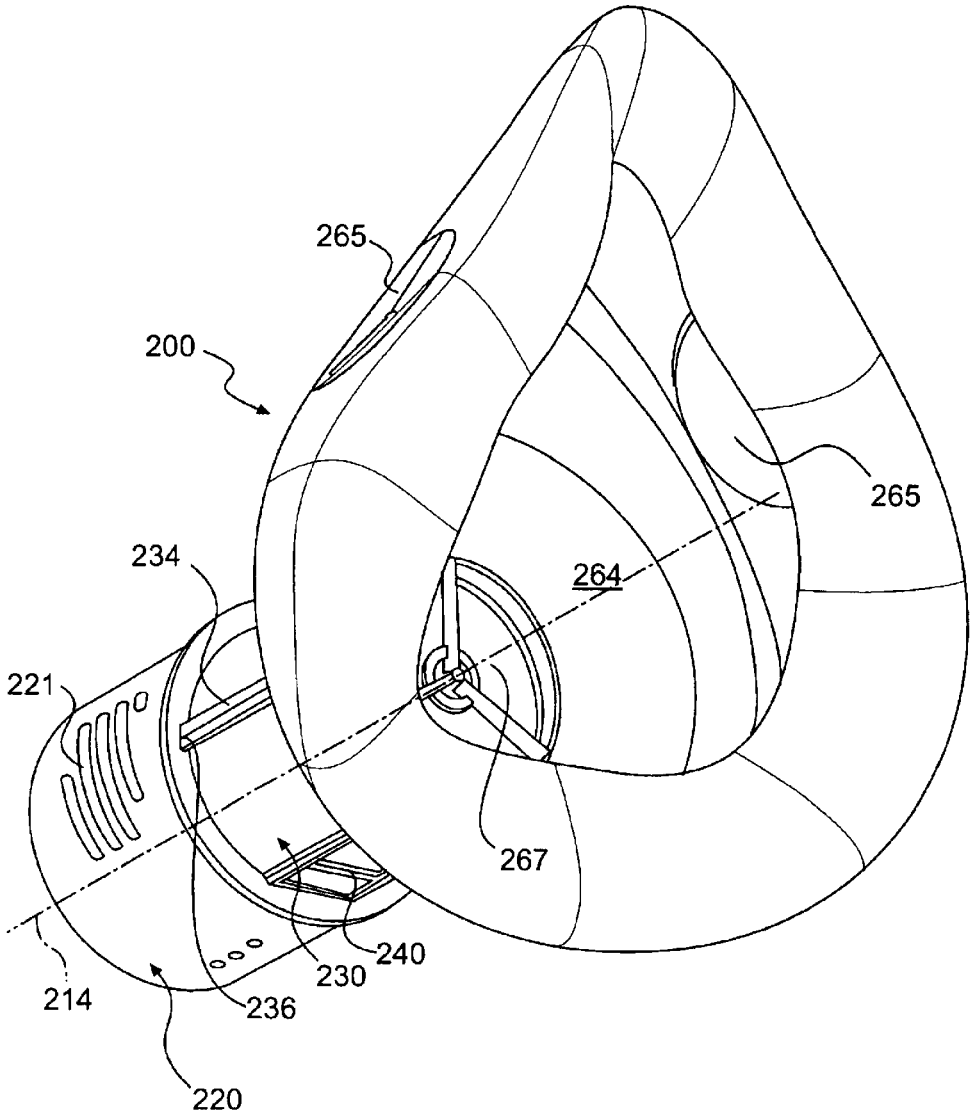
FIG. 7 is a partial perspective view of the breathing mask and mask adjustment mechanism of the helmet of FIG. 1.

As illustrated in FIGS. 1 and 6, the cover 60 of the detachable portion 42 forms the forward side of the detachable portion 42. The protrusions 80 extend forwardly through triangularly shaped holes 83 on either lateral side of the cover 60.

While the illustrated latch mechanism 52 utilizes left and right sets of hooks 68 and slots 78, various other types of latch mechanisms may also be used to releasably secure the detachable portion 42 to the fixed portion 40 without departing from the scope of the present invention. For example, the connection could be magnetic, rather than mechanical.

When the detachable portion 42 is in the attached position, rearward laterally-outward ends of the detachable portion 42 engage sealing strips 90 disposed on the forward inner sides 48, 49 of the fixed portion 40 (see FIGS. 2 and 3). The sealing strips 90 preferably comprise an elastically deformable material such as foam or rubber. The sealing strips 90 discourage cold air from entering the inner space 34 of the helmet 10 between the detachable and fixed portions 42, 40 of the jaw shield 30.

As illustrated in FIGS. 1 and 3, a breathing mask 200 is adjustably connected to the detachable portion 40 of the jaw shield 30 via an adjustment mechanism 210. FIG. 6 is an exploded view of the detachable portion 42, the breathing mask 200, and the mask adjustment mechanism 210. As illustrated in FIG. 4, a control knob 212 connects to the detachable portion 42 for free rotation relative to the detachable portion 42 about an axis 214. However, the connection between the knob 212 and the detachable portion 42 prevents the knob from moving along the axis 214 relative to the detachable portion 42. In the illustrated embodiment, the knob 212 is specifically connected to the cover 60 of the detachable portion 42, but may alternatively be connected to the main body of the detachable portion 42. The axis 214 intersects a generally forward, middle portion of the detachable portion 42 of the jaw shield 30 and generally intersects the wearer's mouth and nose when the wearer is wearing the helmet 10. The knob 212 includes a central, internally-threaded bore 216 that is aligned with the axis 214.

As illustrated in FIGS. 6, 7, 22, and 23 an outer axial member 220 of the mask adjustment mechanism 210 includes, on its outer semi-cylindrical surface, an externally-threaded portion 221 that is threaded into the internally threaded bore 216 (see FIG. 6) of the control knob 212 such that the outer axial member 220 connects to the jaw shield 30 via its connection to the knob 212. The outer axial member 220 is aligned with the axis 214.

The outer axial member 220 includes an inner axially extending bore 222 that extends along the axis 214 such that the outer axial member 220 generally comprises a hollow, axially-extending tube that has a generally ring-shaped cross-section.

An inner axial member 230 includes an outer generally-cylindrical surface that telescopically fits into the bore 222 of the outer axial member 220. The inner axial member 230 also includes an internal axially-extending bore 232 that is aligned with the axis 214 when the inner axial member 230 is fit into the outer axial member 220.

As illustrated in FIGS. 6, 7, 22, and 23, the outer semi-cylindrical surface of the inner axial member 230 includes an axially-extending surface feature/stop (a flat portion in the illustrated embodiment) 234 that engages a corresponding axially-extending surface feature/stop 236 (also a flat portion in the illustrated embodiment) formed on the inside of the bore 222 of the outer axial member 220 to prevent the axial members 220, 230 from rotating relative to each other about the axis 214, while allowing the axial members 220, 230 to telescopically axially slide relative to each other.

As shown in FIGS. 6, 7, 22, and 23, the outer semi-cylindrical surface of the inner axial member 230 and the inside semi-cylindrical surface of the bore 222 of the outer axial member 220 also include annular stops 240 (such as notches and/or protrusions) that discourage relative telescopic movement between the axial members 220, 230 along the axis 214.

Figure 23:
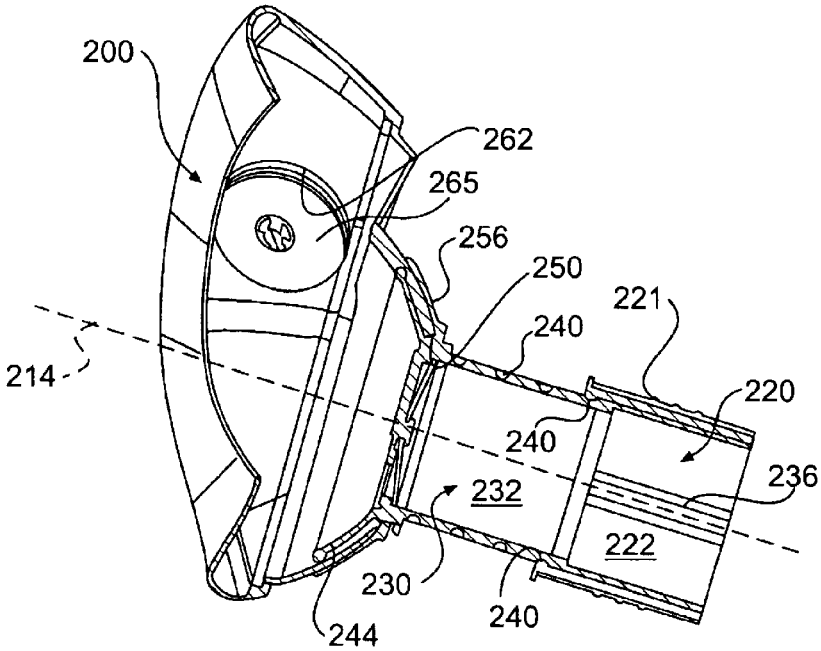
FIG. 23 is a partial cross-sectional view of the breathing mask and breathing mask adjustment mechanism, taken along the line 23—23 in FIG. 22.

As illustrated in FIGS. 6 and 23, a rearward axial end 244 of the inner axial member 230 flares radially-outwardly and rearwardly in the shape of a funnel. The breathing mask 200 includes a central bore 250 that is slightly larger than the generally-cylindrical outer surface of the inner axial member 230. The inner axial member 230 extends forwardly through the central bore 250 of the breathing mask 200. An annular, saucer-shaped, breathing mask clamp 256 also fits over the inner axial member 230 to clamp the breathing mask 200 onto the rearward axial end of the inner axial member 230 between the flared rearward axial end 244 and the breathing mask clamp 256. The breathing mask 200 cannot, therefore, move along the axis 214 relative to the inner axial member 230. Because the rearward axial end 244 and the breathing mask clamp 256 are both somewhat flexible, the breathing mask 200 can swivel relative to the inner axial member 230. In other words, the breathing mask 200 can pivot to some extent relative to the inner axial member 230. The breathing mask 200 can therefore swivel to fit the face of the wearer.

As illustrated in FIG. 3, a ring-shaped upper end of an accordion-folded connector 260 is clamped between the flared rearward axial end 244 and the breathing mask clamp 256 in addition to the breathing mask 200. The connector 260 is either rigidly clamped to the inner axial member 230 or includes a notch that engages a corresponding protrusion in the inner axial member to prevent the upper end the connector 260 from rotating relative to the inner axial member 230. The locations of the notch and protrusion, of course, may be interposed. The connector 260 preferably comprises a piece of sheet metal that is folded in an accordion pattern, which provides at least a moderate amount of flexibility. A lower end of the connector 260 is rigidly connected to the detachable portion 42. Consequently, the connector 260 generally prevents the inner axial member 230 from significantly rotating relative to the detachable portion 42 about the axis 214.

The connector 260 may alternatively comprise a variety of other shapes and materials. For example, the connector 260 may simply comprise a string or tether that connects between the breathing mask 200 and the detachable jaw portion 42 to discourage the mask 200 from rotating relative to the detachable portion 42 about the axis 214. Furthermore, while the illustrated connector 260 comprises an accordion-shaped sheet of metal, the connector 260 may alternatively comprise a variety of other materials such as rubber, another elastomeric material, string, plastic, etc.

The mask adjustment mechanism 210 includes both fine and gross adjustment devices. The adjustment devices each move the breathing mask 200 along an axial path defined by the axis 214 such that the breathing mask 200 can move (a) away from an interior surface of the jaw shield 30 and toward the mouth and nose of the wearer and (b) toward the interior surface of the jaw shield 30 and away from the mouth and nose of the wearer. Unlike prior art breathing mask adjustment devices that rely on flexible straps and the wearer's face to hold the breathing mask in place, the mask adjustment mechanism 210 controls the position of the breathing mask 200 relative to the jaw shield 30 regardless of whether or not the wearer is wearing the helmet 10. Consequently, the mask adjustment mechanism 210 can hold the breathing mask 200 in front of the wearer's nose and mouth while the wearer is wearing the helmet 10 without having the breathing mask 200 come in contact with the wearer.

Gross adjustment of the breathing mask is performed by pushing or pulling the breathing mask 200 along the axis 214, thereby forcing the axial members 220, 230 to telescopically move relative to each other despite the frictional resistance to such telescopic movement created by the annular stops 240 on the axial members 220, 230. Gross adjustment can be performed while the detachable portion 42 is detached from the helmet 10, when the detachable portion 42 is pivotally connected to the helmet 10 but not in the attached position, or when the detachable portion 42 is in the attached position.

Once the gross adjustment of the breathing mask 200 is completed, the wearer uses the knob 212 to finely adjust the axial position of the breathing mask 200. Fine adjustment is preferably performed while the wearer is wearing the helmet 10 and the detachable portion 42 is in the attached position such that the wearer can accurately and precisely position the breathing mask 200 against his/her mouth and nose to prevent humid exhaled air from escaping out of the breathing mask 200 into the inner space 34 of the helmet 10.

The knob 212 preferably includes surface features such as protrusions and/or notches 268 (see FIG. 4) that make it easier for the wearer to turn the knob 212 with his/her gloved hand. By rotating the knob 212 with his/her hand, the threaded engagement between the outer axial member 220 and the knob 212 causes the outer axial member 220 (and consequently the inner axial member 230 and the breathing mask 200) to move along the axial path. The knob 212 may be rotated in either direction, resulting in movement of the breathing mask 200 toward or away from the inner surface of the detachable portion 42. The pitch of the threads on the outer axial member 220 and the bore 216 determine the magnitude of axial movement of the breathing mask 200 per degree of rotation of the knob 212. If right-hand threads are used on the knob 212 and outer axial member 220, clockwise rotation of the knob 212 (as viewed in FIG. 4) will push the breathing mask 200 outwardly toward the interior surface of the detachable portion 42 and away from the wearer's mouth and nose.

For rotation of the knob 212 to force the outer axial member 220 to move axially, the outer axial member 220 should not rotate significantly with the knob 212. The outer axial member 220 is therefore prevented from rotating significantly with the knob 212 because of the rotational engagement of the outer axial member 220 with the inner axial member 230, which is prevented from significantly rotating relative to the detachable portion 42 by the connector 260. It should be noted that other systems may alternatively be used to prevent the outer axial member 220 from rotating with the knob 212. For example, an axially extending notch or protrusion could be formed in the outer axial member 220 and mate with a radially-inwardly extending notch or protrusion that is rigidly connected to the detachable portion 42. Such mating notches/protrusions would directly prevent the outer axial member 220 from rotating relative to the detachable portion 42. Alternatively, the helmet 10 could rely on a general contact between the wearer's face and the breathing mask 200 to prevent the breathing mask 200 (and, consequently, the outer and inner axial members 220, 230) from significantly rotating relative to the detachable portion 42 during operation of the fine adjustment device.

As illustrated in FIGS. 1 and 6, left and right inlet air passageways (or openings) 262 are formed in the breathing mask 200 to fluidly connect the inner space 34 of the helmet 10 to an inner portion (or breathing space) 264 of the breathing mask 200 and allow the wearer to inhale air from within the inner space 34. Check valves 265 disposed within the inlet air passages 262 discourage humid exhaled air from entering the inner space 34 and condensing within the helmet 10. Because the wearer inhales air from within the inner space 34, the inhaled air is at least slightly warmed (relative to the ambient environment) and air continuously circulates into and out of the inner space 34. Fresh air enters the inner space 34 through any openings/gaps in the helmet 10, especially at the neck of the wearer. While the illustrated air inlet passageways 262 are quite short (i.e., extending only over the thickness of the breathing mask 200), the air inlet passageways 262 may alternatively comprise elongated tubular passageways that have a variety of lengths and/or cross-sections.

The internal bore 232 in the inner axial member 230 and the internal bore 222 of the outer axial member 220 combine to define an exhaust air passageway (or opening) 266. The exhaust air passageway 266 fluidly connects the inner portion 264 of the breathing mask 200 to the ambient environment to allow humid air exhaled by the wearer to vent outwardly without getting into the inner space 34 of the helmet 10. As illustrated in FIG. 6, a check valve 267 is disposed in the exhaust air passageway 266 to prevent ambient air outside the helmet 10 from entering the mask 200 through the exhaust air passageway 266. While the illustrated exhaust air passageway 266 comprises an elongated tube, the passageway 266 may alternatively be short in an axial direction. While the cross-sectional shape of the exhaust air passageway 266 is generally circular in this embodiment, the exhaust air passageway 266 may have a variety of alternative tubular shapes (for example, rectangular, oval, irregular, polygonal, or varying shapes) without deviating from the scope of the present invention.

Figure 24:
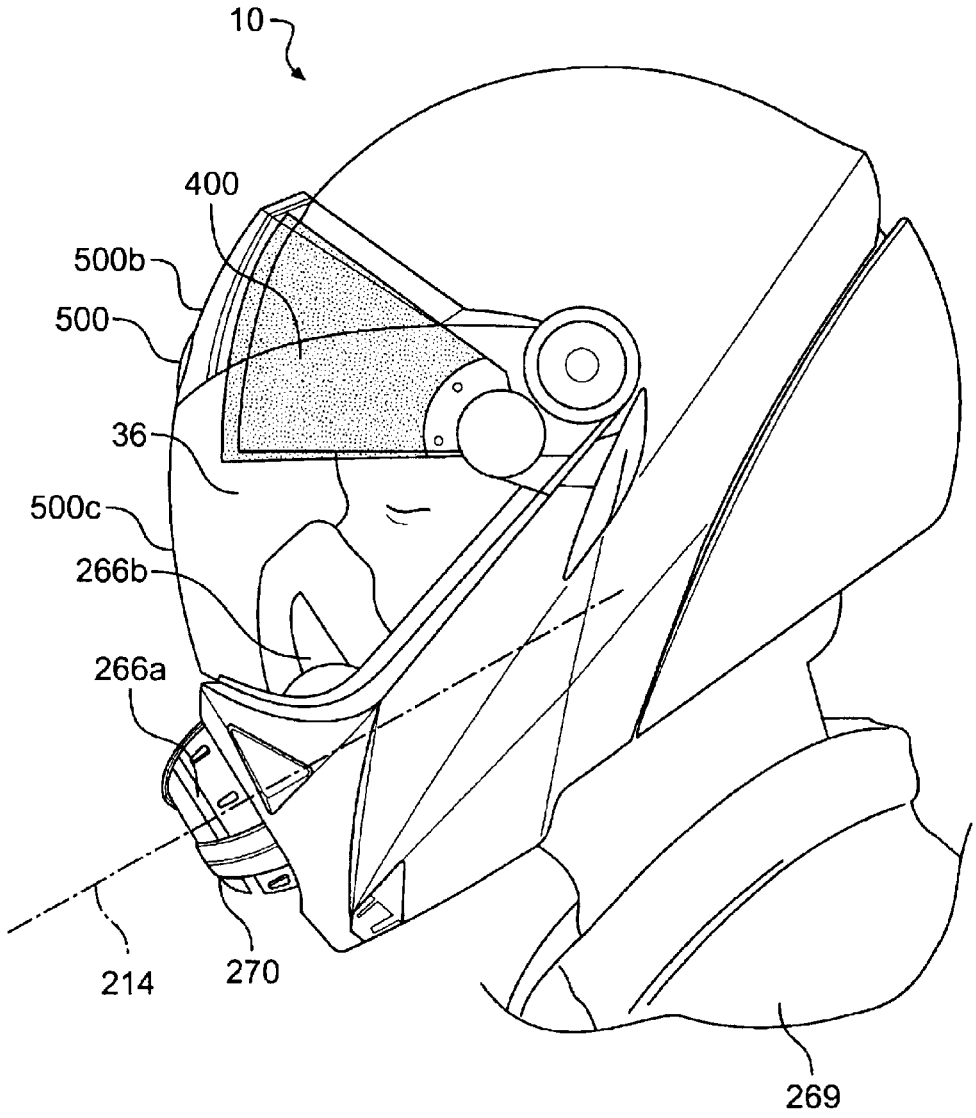
FIG. 24 is a side view of a person wearing the helmet of FIG. 1.

The center of the exhaust air passageway 266 extends along the axis 214. As illustrated in FIG. 24, when a person 269 wears the helmet 10, the axis 214 and the exhaust air passage 266 angle downwardly as the air passageway projects away from the mouth and nose of the person 269. Because an external end 266*a* of the exhaust air passageway 266 is disposed below an internal end 266*b* of the exhaust air passageway 266, humid exhaled air that condenses in the exhaust air passageway 266 will tend to flow under the force of gravity down the exhaust air passageway 266 and out of the external end 266*a*. The external end 266*a* opens up to the ambient environment in a forward and downward direction. Consequently, condensed water will tend not to accumulate or freeze within the passageway 266.

While the illustrated exhaust air passageway 266 extends linearly such that the axis 214 defines its center, exhaust air passageways according to the present invention may have a variety of alternative longitudinal shapes (e.g., center lines that include simple or compound curves, irregular shapes, angles, etc.). Regardless of the specific longitudinal shape of the exhaust air passageway, the air passageway should generally extend downwardly as it extends away from the wearer's face so that condensed water tends to flow out of the air passageway.

To discourage fresh air from being forced into the exhaust air passageway 266 as the wearer travels forwardly on a vehicle, an air deflector 270 (see FIGS. 1 and 6) fits into the inner bore 222 of the outer axial member 220 and is positioned in front of the external end 266*a* of the exhaust air passageway 266 to deflect air away from the exhaust air passageway 266. The air deflector 270 is open on its sides to allow exhaled air to exit the exhaust air passageway 266. The air deflector 270 and the exhaust air check valve 267 combine to generally discourage ambient fresh air from entering the exhaust air passageway 266. Consequently, more warm exhaled air than cold ambient air moves through the exhaust air passageway 266, which generally raises the temperature within the exhaust air passageway 266 and discourages the humid exhaust air from condensing and freezing within the exhaust air passageway 266. This discourages ice from building up within and clogging the exhaust air passageway 266.

While separate exhaust and inlet air passageways 262, 266 are preferred, the inlet air passageways 262 and check valves 265, 267 may be eliminated such that the exhaust air passageway 266 serves as a passageway for both inlet/fresh air and exhaled humid air without deviating from the scope of the present invention.

Various modifications to the mask adjustment mechanism 210 may be made without deviating from the scope of the present invention. For example, just one of the two adjustment devices (telescopic/rotational) may be used. Further, the knob 212 may be coupled to the outer axial member 220 instead of to the detachable portion 42. In such an embodiment, the knob 212 may freely rotate relative to the outer axial member 220, but be prevented from moving axially relative to the outer axial member 220. The knob 212 may include external threads that would mesh with internal threads rigidly formed in a bore in the detachable portion 42. Additional changes and modifications may also be made to the mask adjustment mechanism 210 without departing from the scope of the present invention, as would be appreciated by one of ordinary skill in the art.

Figure 8:
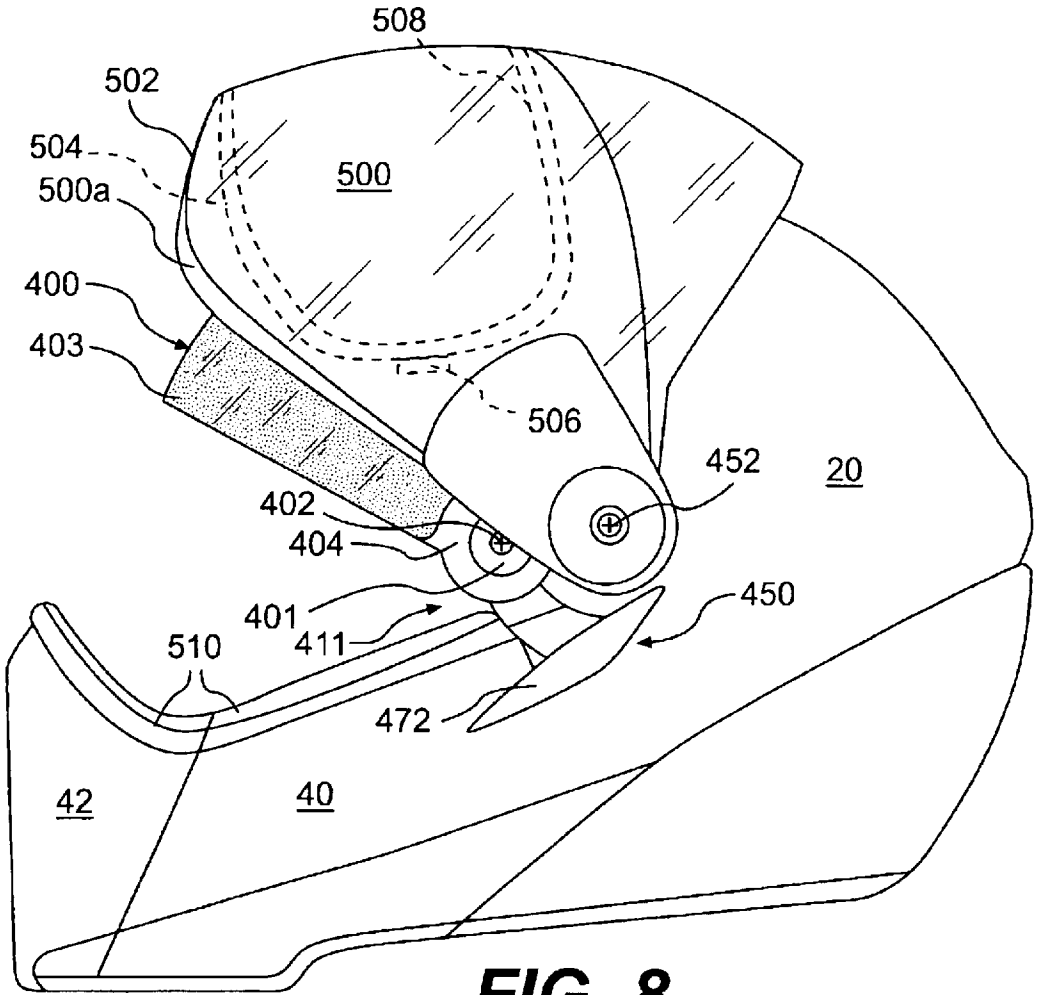
FIG. 8 is a left side view of the helmet of FIG. 1 with the detachable jaw shield removed.

As illustrated in FIG. 8, a tinted shield 400 is pivotally connected by left and right bolts 401 to the head portion 20 for pivotal movement relative to the head portion 20 about a laterally extending tinted shield axis 402. The tinted shield 400 is pivotally movable between (a) a raised position, in which the tinted shield 400 is at least partially above the opening 36 and substantially out of the wearer's field of vision (as shown in FIG. 8), and (b) a lowered position, in which the tinted shield 400 is disposed in the semi-crescent shaped opening 36 in front of the wearer's eyes.

Figure 9:
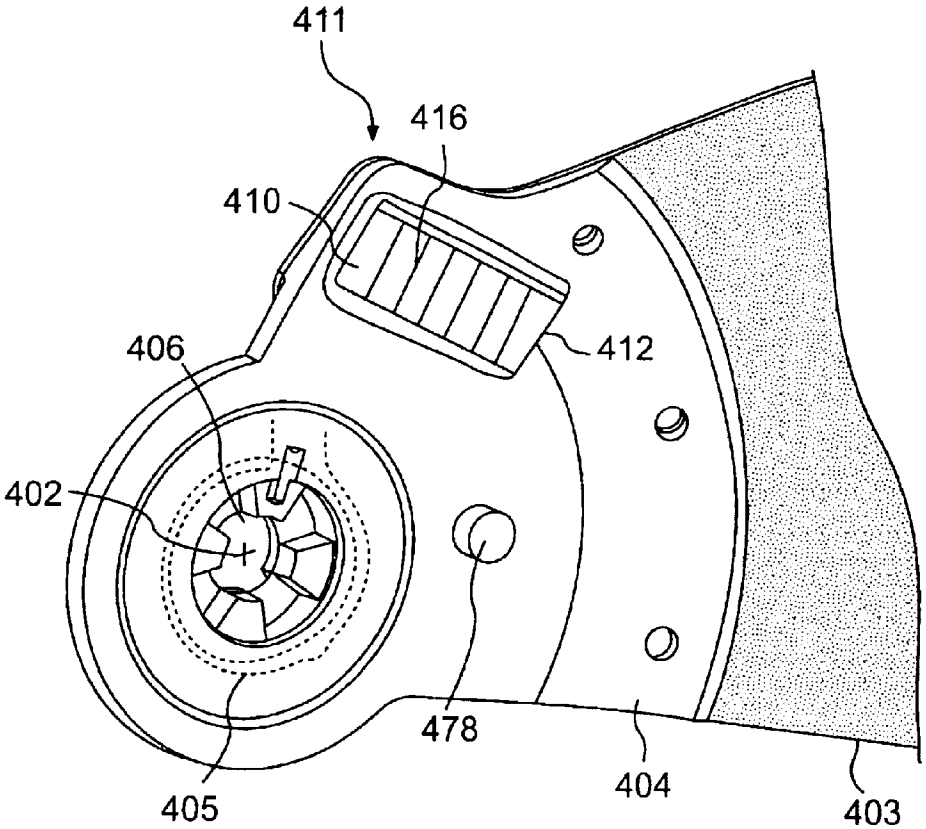
FIG. 9 is a partial side view of the tinted shield of the helmet of FIG. 1 showing the inner left side of one end of the tinted shield.

As illustrated in FIG. 9, a resilient member 405 connects between the tinted shield 400 and the head portion 20 to bias the tinted shield into its raised position. Alternatively, the resilient member 405 could connect between the tinted shield 400 and an eye shield 500. The illustrated resilient member 405 is a torsion spring that is pre-tensioned before the tinted shield 400 is mounted to the head portion 20. When the tinted shield 400 is mounted to the head portion 20, the torsion spring 405 urges the tinted shield 400 upwardly (clockwise as illustrated in FIG. 10) into its raised position so that the tinted shield 400 will not fall into its lowered position under the force of gravity or some jostling movement.

In the illustrated embodiment, the tinted shield 400 comprises a semi-spherical semi-crescent shaped tinted see-through portion 403 with left and right sides 404 riveted or otherwise attached to the laterally-outer ends of the see-through portion 403. As illustrated in FIG. 2, the lower edge of the tinted shield 400 generally follows the contours of the upper edge of the jaw shield 30.

FIG. 9 is a partial side view of the left inside of the tinted shield 400 with the tinted shield removed from the helmet 10. A hole 406 through which the bolt 401 fits is disposed through the left side 404 of the tinted shield 400 and aligned with the axis 402 when the tinted shield 400 is mounted to the helmet 10.

Figure 10:
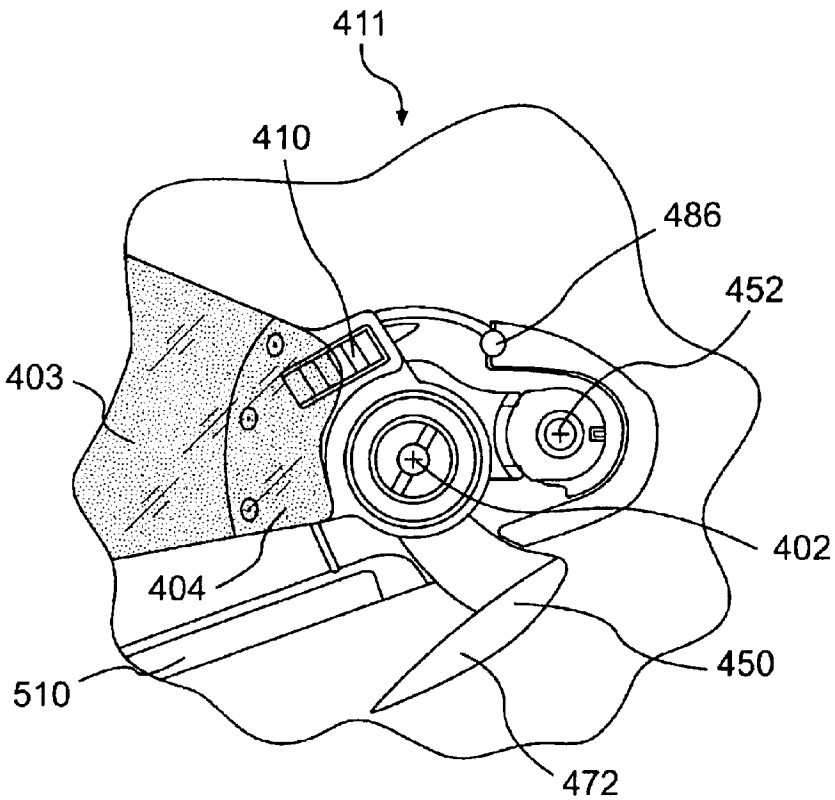
FIG. 10 is a partial left side view of the helmet of FIG. 1 with the eye shield removed.

As best illustrated in FIG. 10, a holding device 411 is disposed between the tinted shield 400 and the head portion 20 to selectively hold the tinted shield 400 in its lowered position despite the raising force being applied to the tinted shield 400 by the resilient member 405.

The illustrated holding device 411 includes a rectangular tooth-anchor 410 that is formed on the left side 404 of the tinted shield 400. The long edges of the rectangular tooth-anchor 410 are generally perpendicular to a line that connects between the axis 402 and a middle of the long edges of the rectangular tooth-anchor 410. The tooth-anchor 410 is radially spaced from the axis 402. As illustrated in FIG. 9, the holding device 411 includes a plurality of ratchet teeth 416 disposed on the tooth-anchor 410. When the tinted shield 400 is mounted to the helmet 10, the shallowly-sloped sides of the ratchet teeth 416 face rearwardly and the steeply-sloped sides of the teeth 416 face forwardly. The teeth 416 are generally aligned with a forward small edge 412 of the tooth-anchor 410.

Figure 11:
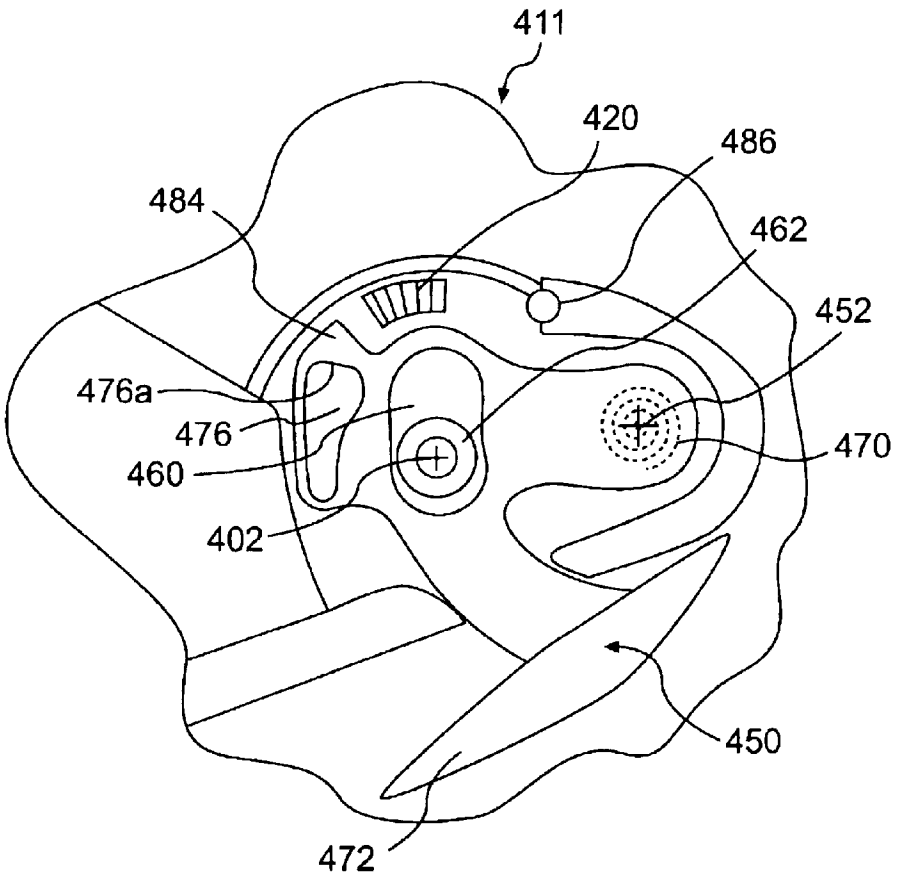
FIG. 11 is a partial left side view of the helmet of FIG. 1 with both the eye shield and the tinted shield removed.

As illustrated in FIG. 11, the holding device 411 further includes a plurality of ratchet teeth 420 disposed on an outer lateral side of the head portion 20 radially outwardly from the tinted shield axis 402. The steeply-sloped sides of the ratchet teeth 420 face forwardly and slightly downwardly while the shallowly-sloped sides of the ratchet teeth 420 face rearwardly and slightly upwardly.

The teeth 420 are positioned so as to not engage the teeth 416 when the tinted shield 400 is in its raised position. However, when the tinted shield is pivoted toward and into the lowered position, the ratchet teeth 420 are positioned to engage the ratchet teeth 416 of the tinted shield 400. When the teeth 416, 420 meet each other, their respective shallowly-sloped sides first engage each other, thereby forcing the teeth 416 outwardly. Because the left side 404 of the tinted shield 400 is made of a flexible material such as plastic, the rectangular tooth-anchor 410 flexes outwardly (generally about the small edge 412) away from the head portion 420. The outward movement of the tooth-anchor 410 enables the teeth 416 to slide over the teeth 420 until the tooth-anchor 410 flexes back into its unflexed position, at which point the steeply-sloped sides of the teeth 416 engage the steeply-sloped sides of the teeth 420 to prevent the tinted shield 400 from rotating back into its raised position despite the raising force being applied to the tinted shield 400 by the resilient member 405.

Because there are a plurality of teeth 416, 420, a plurality of lowered positions of the tinted shield 400 are defined, one lowered position for each possible combination of mating teeth 416, 420.

Figure 25:
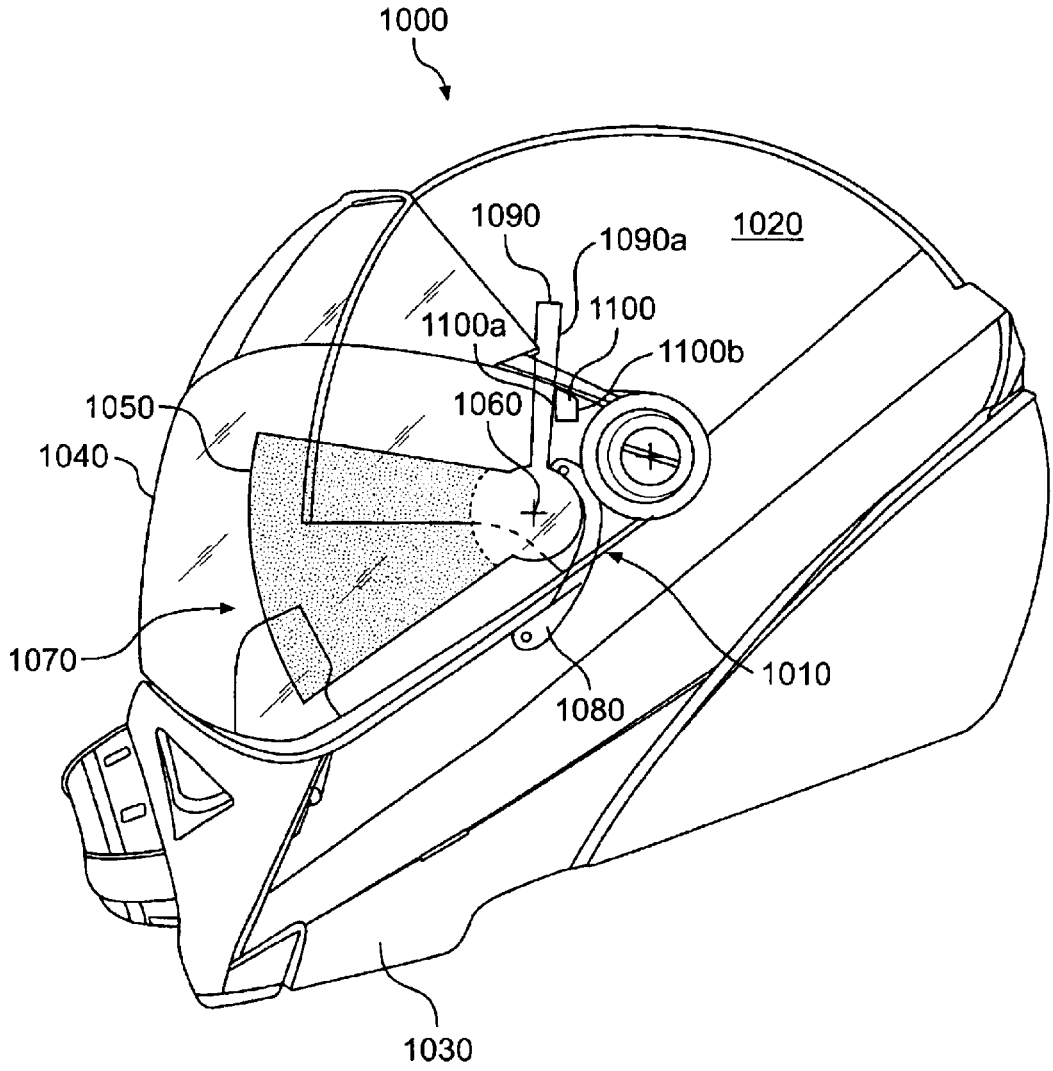
FIG. 25 is a side view of a helmet having a tinted shield holding device with the tinted shield in a lowered position according to an alternative embodiment of the present invention.
Figure 26:
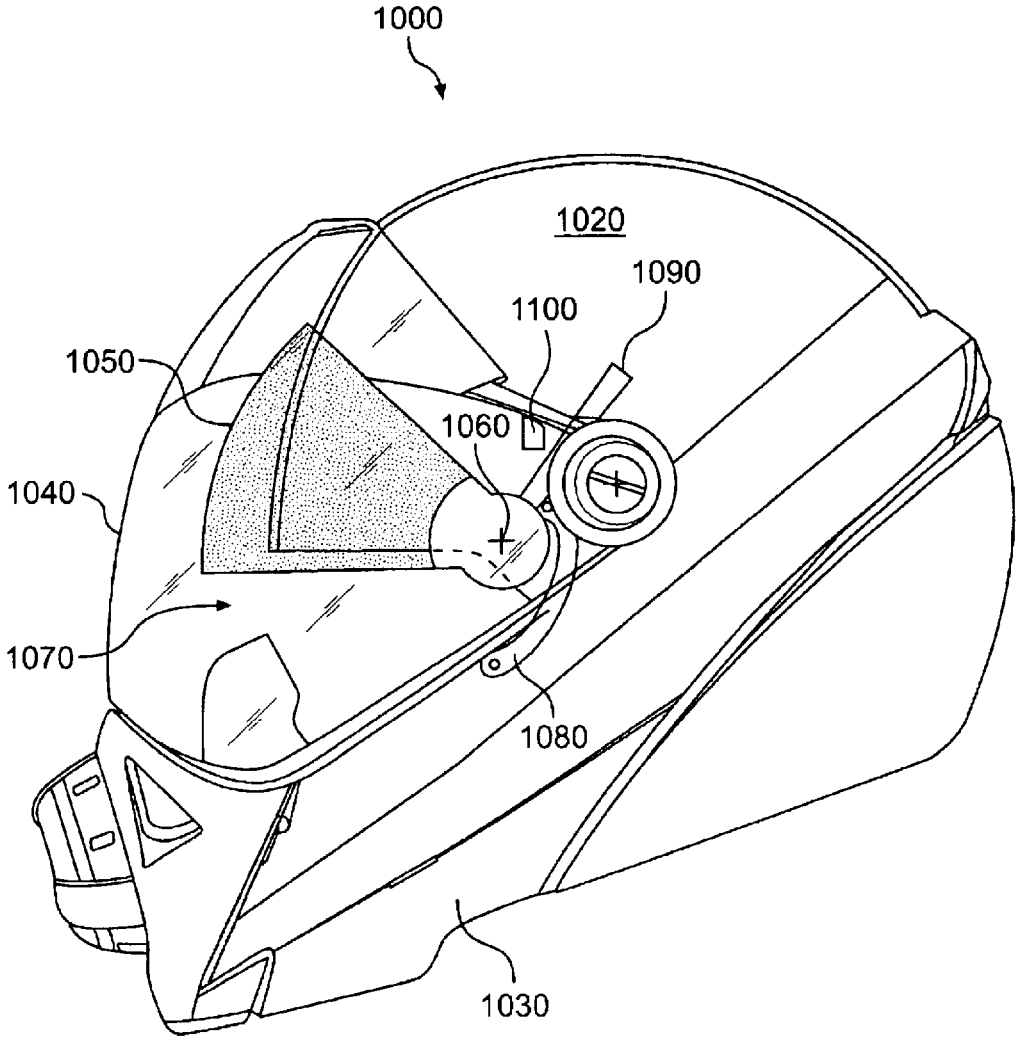
FIG. 26 is a side view of the helmet of FIG. 25 with the tinted shield in a raised position.

A variety of other types of holding devices may be used instead of the illustrated ratchet-teeth-based holding device, as would be appreciated by one of ordinary skill in the art. For example, FIGS. 25 and 26 illustrates a helmet 1000 that includes an alternative holding device 1010. The holding device 1010 may replace the holding device 411 of the helmet 10 without deviating from the scope of the present invention. Because the helmet 1000 is similar to the helmet 10, a redundant description of each of the similar elements is omitted. The helmet 1000 includes a head portion 1020, a jaw shield 1030, an eye shield 1040, and a tinted shield 1050 disposed between the head portion 1020 and the eye shield 1040.

The tinted shield 1050 is pivotally connected to the head portion 1020 for pivotal movement relative to the head portion 20 about a laterally extending tinted shield axis 1060. The tinted shield 1050 is pivotally movable between (a) a raised position, in which the tinted shield 1050 is at least partially above an opening 1070 formed between the head portion 1020 and the jaw shield 1030 and substantially out of the wearer's field of vision (as shown in FIG. 26), and (b) a lowered position, in which the tinted shield 1050 is disposed in the semi-crescent shaped opening 1070 in front of the wearer's eyes (as shown in FIG. 25).

A resilient member 1080 connects between the tinted shield 1050 and the head portion 1020 to bias the tinted shield 1050 into its raised position. In this embodiment, the resilient member 1080 is a resilient plastic spring that is connected at one end to the head portion 1020 and at an opposite end to the tinted shield 1050. Because the plastic spring 1080 is resiliently bent around a base portion of the tinted shield 1050, the spring 1080 biases the tinted shield into its raised position. While the illustrated resilient member 1080 is a plastic spring, a variety of other resilient members may alternatively be used to bias the tinted shield 1050 upwardly (for example, a torsion spring such as the resilient member 405 illustrated in FIG. 9, a rubber band or other tensile piece of rubber, a tension spring, a compression spring, etc.).

The holding device 1010 is disposed between the eye shield 1040 and the head portion. The holding device 1010 selectively holds the tinted shield 1050 in its lowered position despite the raising force being applied to the tinted shield 1050 by the resilient member 1080.

The holding device 1010 includes a lever 1090 and a detent 1100, which selectively engage each other to hold the tinted shield in the lowered position.

The lever 1090 extends upwardly from one side of the tinted shield 1050. The illustrated lever 1090 is integrally formed with the base portion of the tinted shield 1050, but may alternatively be otherwise attached to the tinted shield 1050 (via, for example, glue, bolts, screws, rivets, etc.). The lever 1090 pivots with the tinted shield 1050 about the tinted shield axis 1060 relative to the head portion 1020. The lever 1090 comprises a flexible material that enables an upper portion of the lever 1090 to flex in the direction of the tinted shield axis (into and out of the page as illustrated in FIGS. 25 and 26).

The detent 1100 protrudes inwardly from an upper rearward portion of the eye shield 1040 toward the head portion 1020. In the illustrated embodiment, the detent 1100 is integrally formed with the eye shield 1040. However, the detent may alternatively be otherwise attached to the eye shield 1040 (via, for example, glue, bolts, screws, rivets, etc.). A forward surface 1100*a* of the detent 1100 abuts against a rearward surface 1090*a* of the lever 1090 to prevent the tinted shield from moving from its lowered position into its raised position when the eye shield 1040 is lowered. When the eye shield 1040 and tinted shield 1050 are both in their lowered positions (see FIG. 25), raising the eye shield 1040 into its raised position pivots the detent 1100 rearwardly away from the lever 1090, which allows the tinted shield 1050 to move into its raised position under the force of the resilient member 1080.

When the eye shield 1040 and tinted shield 1050 are both in their lowered positions (see FIG. 25), the tinted shield 1040 may be raised without raising the eye shield 1050 by pressing the upper, exposed portion of the lever 1090 inwardly toward the head portion 1020. Pressing the lever 1090 inwardly causes its upper portion to flex inwardly and its rearward surface 1090*a* to disengage from the forward surface 1100*a* and pivot rearwardly past the forward surface 1100*a*. This, in turn, allows the tinted shield 1050 to move into its raised position (see FIG. 26).

A rearward surface 1100*b* of the detent 1100 angles inwardly toward the head portion 1020 as it progresses forwardly toward the forward surface 1100*a*. Consequently, the detent 100 has a generally ramp-like shape when viewed from above. When the eye shield is in the lowered position and the tinted shield is in its raise position (see FIG. 26), the wearer can lower the tinted shield 1050 by pushing the exposed portion of the lever 1090 forward (counterclockwise as shown in FIGS. 25 and 26). As the lever 1090 passes the detent, the ramp-like, rearward surface 1090*b* flexes the lever 1090 inwardly so that it can slide past the detent 1100. Once the rearward surface of the lever 1090 moves in front of the forward surface 1100*a* of the detent 1100, the lever 1090 flexes outwardly and engages the detent 1100 to hold the tinted shield 1050 in its lowered position.

The illustrated detent 1100 is mounted to the eye shield 1040 such that the holding device 1010 controls relative movement between the tinted shield 1050 and the eye shield 1040. However, the detent could alternatively be mounted to the head portion such that the holding device would control the position of the tinted shield relative to the head portion (see, e.g., the holding device 411). In such an embodiment, the wearer would push the lever outwardly rather than inwardly to raise the tinted shield.

Hereinafter, the tinted shield control lever 450 will be described with reference to FIGS. 10 and 11. The lever 450 is pivotally connected to the head portion 20 for rotation relative to the head portion 20 about a laterally-extending lever axis 452. However, it should be noted that the lever 450 could alternatively pivot about the tinted shield axis 402 without deviating from the scope of the present invention.

Returning to the embodiment illustrated in FIGS. 1–10, as illustrated in FIG. 11, an oblong hole 460 in the lever 450 fits over a protrusion 462 on the head portion 20 that defines the tinted shield axis 402. Consequently, the lever is constrained by the hole 460 and protrusion 462 to pivotal movement over a fixed, preferably acute arc. A resilient member 470 connects between the lever 450 and the head portion 20 to bias the lever 450 into a neutral position that is part way between the extreme pivotal positions of the lever 450 over the fixed arc. The resilient member 470 is illustrated as a bi-directional torsion spring, but could alternatively comprise any other type of resilient member such as a rubber/elastic band, a tension spring, a compression spring, a combination of several resilient members, etc. The lever 450 includes a handle portion 472 designed to be grasped by the wearer's gloved hand. The handle portion 472 can be pulled downwardly to pivot the lever 450 downwardly (counterclockwise as shown in FIG. 11) relative to the neutral position in a tinted shield 400 lowering direction. Conversely, the handle portion 472 can be pushed upwardly to pivot the lever 450 upwardly (clockwise as shown in FIG. 11), relative to the neutral position, in a tinted shield 400 raising direction.

As illustrated in FIG. 11, the lever 450 includes a lowering hole 476. An inwardly-extending lowering protrusion 478 formed on the inside of the left side 404 of the tinted shield 400 (see FIG. 9) fits into the lowering hole 476 when the tinted shield 400 is mounted to the helmet 10. Consequently, when the lever 450 is moved in the lowering direction, an upper edge 476*a* of the lowering hole 476 engages the lowering protrusion 478 and pulls the tinted shield 400 downwardly (counterclockwise as shown in FIG. 10) into its lowered position. As discussed above, the teeth 416, 420 of the holding device automatically lock the tinted shield 400 into the lowered position to prevent the tinted shield from moving upwardly under the force of the resilient member 405. Thus, when the wearer releases the lever 450 and allows it to return to its neutral position under the biasing force of the resilient member 470, the tinted shield 400 remains in its lowered position. The raising force of the resilient member 405 prevents the tinted shield 400 from pivoting downwardly further unless the lever 450 is again pushed downwardly to further lower the tinted shield 400.

The lever 450 further includes a raising wedge 484. The wedge 484 is positioned on the lever 450 such that when the lever 450 is moved in its raising direction, the wedge 484 contacts the teeth 416 of the holding device. Thereafter, a sloped surface of the wedge 484 slidingly engages the shallowly-sloped sides of the teeth 416, thereby forcing the teeth 416 and the tooth-anchor 410 laterally-outwardly until the teeth 416 disengage the teeth 420 on the head portion 20. When the teeth 416, 420 disengage from each other, the tinted shield 400 freely pivots upwardly into its raised position under the biasing force of the resilient member 405. It should be noted that the lowering hole 476 of the lever is long enough in an annular direction relative to the axis 452 that the edges of the hole 476 do not engage the lowering protrusion 478 when the lever 450 is moved in the raising direction. Alternatively, the entire lower side of the lowering hole 476 could be eliminated such that the lowering hole 476 comprises just a lowering upper edge.

As illustrated in FIG. 10, a bumper 486 is provided on the head portion 20 in a position corresponding to an upper edge of the tinted shield 400 when the tinted shield 400 is in its raised position. The bumper 486 cushions the impact force of the upwardly-moving tinted shield 400 when the tinted shield 400 is thrust upwardly under the biasing force of the resilient member 405.

As illustrated in FIG. 8, the helmet 10 further includes a protective eye shield 500 pivotally connected to the head portion 20 for pivotal movement relative to the head portion 20 about the lever axis 452. The pivotal connection between the head portion 20 and the eye shield 500 preferably includes frictional surfaces that discourage pivotal movement of the eye shield 500. Consequently, the eye shield 500 will only pivot between its raised and lowered positions when pushed/pulled by the wearer.

Figure 12:
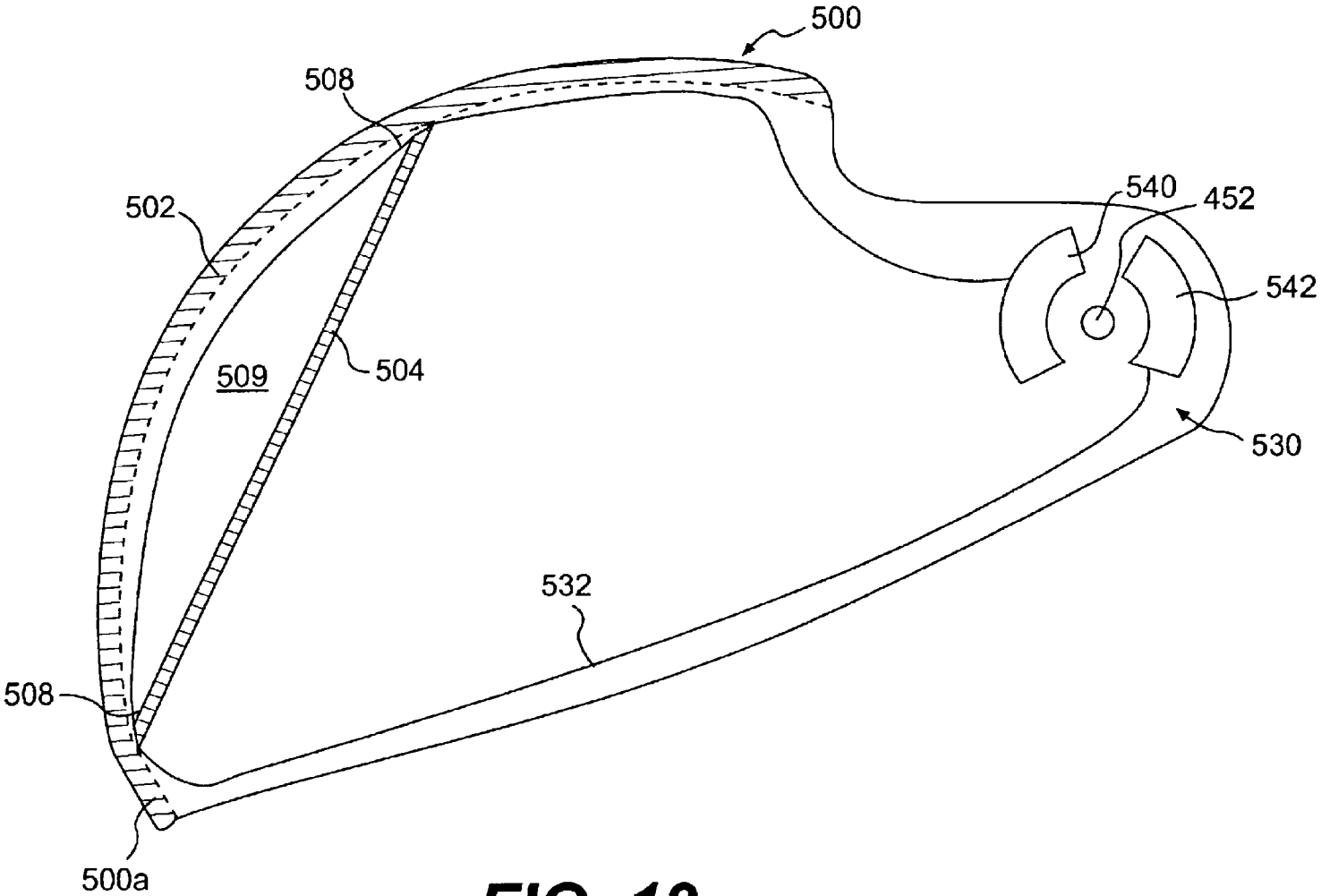
FIG. 12 is a partial side view of the eye shield of the helmet of FIG. 1, showing the inner right side of the eye shield.

As illustrated in FIGS. 8 and 12, the eye shield 500 comprises a double-layer, semi-crescent-shaped clear shield that includes an outer, semi-spherical, semi-crescent shaped layer 502 and an inner, semi-cylindrically shaped layer 504. the inner layer 504 curves from left to right as it progresses around the inside of the outer layer 502. As shown in FIG. 8, tabs 506 extend inwardly from the inner side of the outer layer 502 to hold the inner layer 504 in place between the tabs 506. The perimeter of the inner layer 504 includes a ribbon 508 of silicon that seals the two layers 502, 504 together such that an air space 509 is formed between the layers 502, 504. The air space 509 forms a thermal barrier that discourages condensation on the inner side of the inner layer 504 and the outer side of the outer layer 502 to ensure that the wearer has a clear field of vision through the eye shield 500. While a double-layer eye shield 500 is preferred, the eye shield may alternatively comprise a single layer shield without departing from the scope of the present invention. Furthermore, the inner and outer layers 502, 504 could alternatively both be semi-spherically shaped or both be semi-cylindrically shaped, or both have asymmetrical shapes.

Figure 8A:
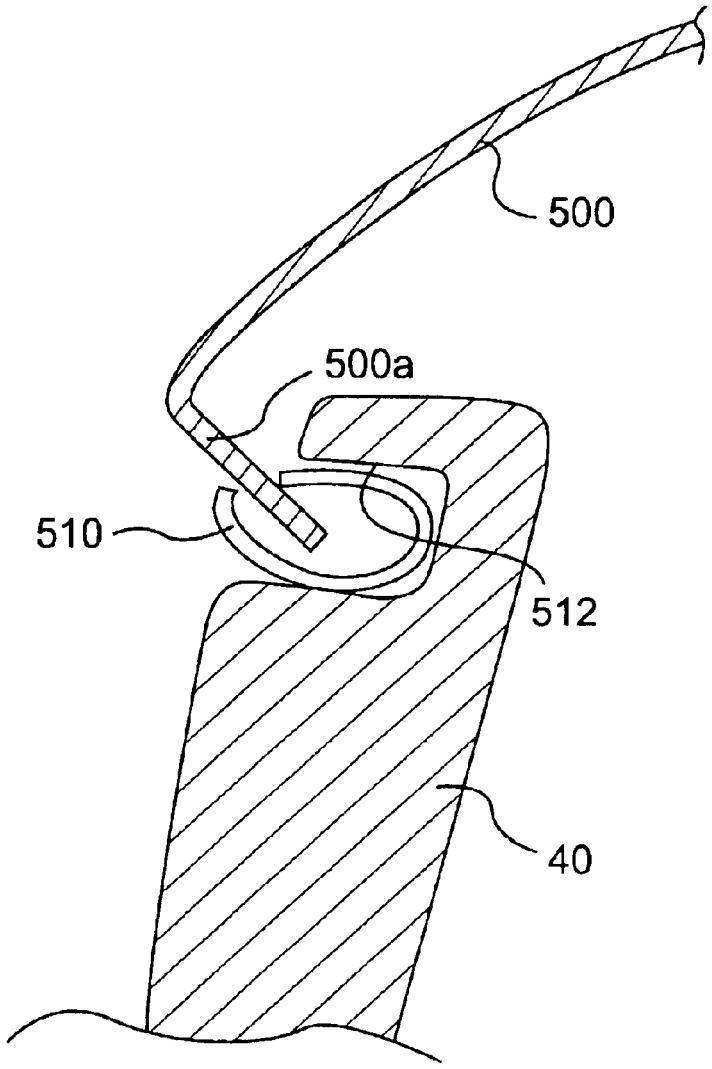
FIG. 8A is a partial cross-sectional view of the eye shield and the jaw shield of the helmet of FIG. 1 with the eye shield in its lowered position.

As illustrated in FIGS. 8A and 12, a lower edge 500*a* of the eye shield 500 extends downwardly away from the remainder of the eye shield 500 in the direction of movement of the eye shield 500 relative to the head portion 20 (i.e., generally perpendicularly to a radial direction of the axis 452). Consequently, when the eye shield 500 is lowered into its lowered position, its lower edge 500*a* engages sealing strips 510 disposed on the jaw shield 20 to create a tight seal that discourages cold air from entering the inner space 34 of the helmet 10. The sealing strips 510 preferably comprise a resilient material such as foam or rubber. The sealing strips 510 preferably have a tubular cross-section that includes a longitudinally extending cut through which the lower edge 500*a* of the eye shield 500 extends when the eye shield 500 is moved into its lower position. As best illustrated in FIG. 8A, the sealing strips 510 are fastened to the jaw shield 40 within channels 512 that are formed in and extend around an upper perimeter of the jaw shield 40. The lower edge 500*a* of the eye shield 500 extends into the channel 512 when the eye shield 500 is lowered.

To further discourage cold air from entering the inner space 34 of the helmet 10, an upper edge of the eye shield 500 is contoured to closely follow the contours of the head portion 20 when the eye shield 500 is in its lowered position. While not shown in this embodiment, a sealing strip may be provided on the head portion 20 or the upper edge of the eye shield 500 to seal the small gap formed between the upper edge of the eye shield 500 and the head portion 20.

In this embodiment, while the tinted and eye shields 400, 500 pivot about separate axes 402, 452, respectively, the helmet 10 may be modified such that both shields 400, 500 would pivot about the same axis without deviating from the scope of the present invention.

As illustrated in FIG. 8, the handle portion 472 of the lever 450 extends downwardly enough that it is disposed below the lower edge of the eye shield 500 even when the eye shield 500 is in its lowered position. When the eye shield 500 is in its lowered position, the tinted shield 400 is disposed behind the eye shield 500 (i.e., closer to the inner space 34 and closer to the wearer) regardless of whether the tinted shield 400 is in its raised or lowered positions. Consequently, the tinted shield 400 may be raised and lowered using the lever 450 even when the eye shield 500 is in its lowered position. The lever 450 therefore advantageously eliminates the need to raise the eye shield 500 in order to reposition the tinted shield 400.

As best illustrated in FIG. 24, the eye shield has upper and lower portions 500*b*, 500*c*. The lower portion 500*c* is the portion that is disposed in front of the opening 36 when the eye shield 500 is in its lowered position and is see-through or clear so that the wearer can see through the lowered eye shield 500. The upper portion 500*b* of the eye shield 500 is disposed above the opening 36 regardless of the position of the eye shield 500. When the eye shield 500 is in its lowered position and the tinted shield 400 is in its raised position, the upper portion 500*b* of the eye shield 500 is disposed in front of the tinted shield. In the illustrated embodiment, the upper portion 500*b* is see-through or clear so that the raised tinted shield 400 may be inspected through the eye shield 500.

Figure 30:
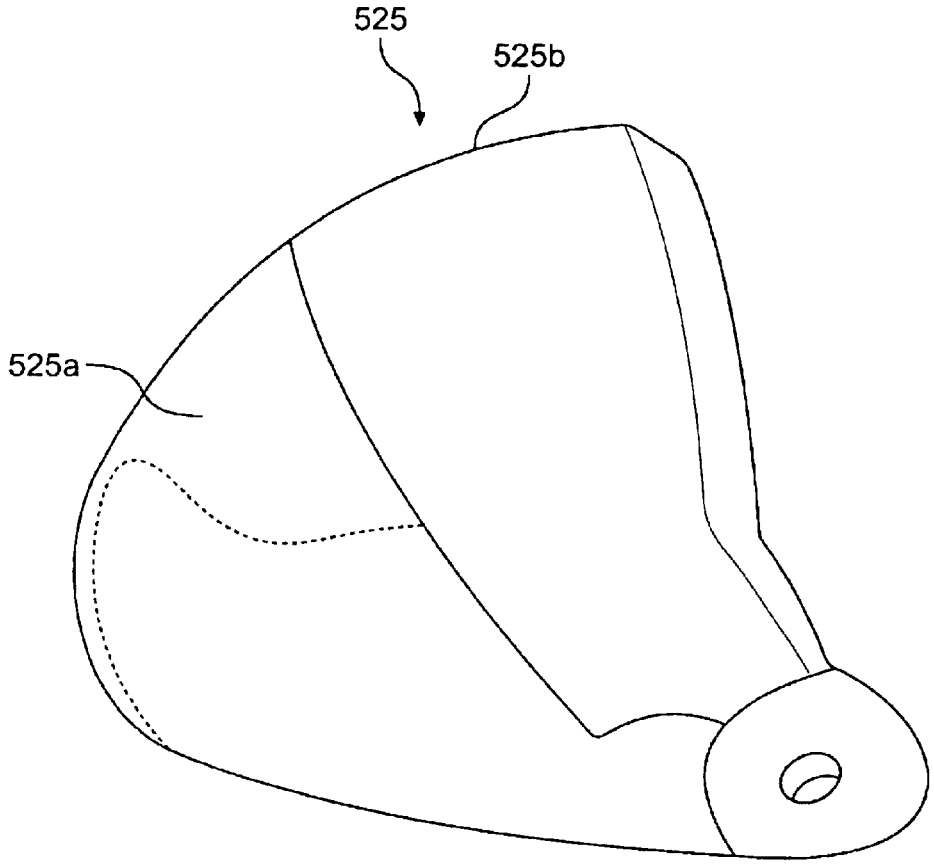
FIG. 30 is a perspective view of an eye shield of a helmet according to an alternative embodiment of the present invention.

While the upper portion 500*b* is clear in the illustrated embodiment, it is also contemplated that the upper portion of the eye shield is opaque or tinted. For example, FIG. 30 illustrates an eye shield 525 that may replace the eye shield 500 of the helmet 10 without deviating from the scope of the present invention. Except as expressly stated herein, the eye shield 525 is identical to the eye shield 500. A lower portion 525*a* of the eye shield 525 is clear to enable the wearer to see through the eye shield 525. An upper portion 525*b* of the eye shield 525 is opaque. The opaque upper portion 525*b* may be created by applying a frosted or opaque layer to the inside of an otherwise see-through portion. For example, the eye shield 525 may be created by applying an opaque layer (spay paint, paint, etc.) to the interior side of the upper portion 500*b* of the eye shield 500 illustrated in FIG. 24. Although the opaque layer may alternatively be applied to the outside of the upper portion 525*b*, the interior side is preferred so that the opaque layer is less exposed to wear and abrasion. Alternatively, the upper portion 525*b* may comprise a material such as plastic that is inherently opaque. In such an embodiment, the lower portion 525*a* and upper portion 525*b* would comprise distinct materials. When the eye shield 525 is mounted to the helmet 10, the eye shield 525 is in its lowered position, and the tinted shield 400 is in its raised position, the upper portion 525*b* hides the tinted shield 400 from view.

As illustrated in FIG. 12, the helmet 10 further includes an eye shield 500 heating system 530 that electrically heats the eye shield 500 to discourage water and frost from forming on the eye shield 500 and obstructing the wearer's view. FIG. 12 is an outwardly looking side view of the inner right side of the eye shield 500. An electric heating element 532, which preferably comprises a thin wire, extends within the space 509 defined between outer and inner layers 502, 504 of the eye shield 500. One end of the heating element 532 is electrically connected to a forward electrical contact surface 540 disposed on the inside surface of the eye shield 500. The forward contact surface 540 is disposed forwardly from and radially outwardly from the lever axis 452. The forward contact surface 540 covers an arc, which has the axis 452 as its centerline. The other end of the heating element 532 is electrically connected to a rearward electrical contact surface 542, which is generally a mirror image of the forward contact surface 540 relative to the axis 542. The forward and rearward contact surfaces 540, 542 each comprise electrically-conductive laterally-inner surfaces.

As illustrated in FIG. 1, the eye shield heating system 530 further includes forward and rearward sets of electrical contact points 550, 552 disposed forwardly and rearwardly, respectively, from the lever axis 452 on the right lateral side of the head portion 20. The electrical contact points 550, 552 are electrically connected to an external power supply jack 560 mounted on the helmet 10. The external power supply jack 560 is adapted to be connected via a power lead (not shown) to an electrical power source such as a snowmobile's battery system. When the eye shield 500 is mounted to the head portion 20, a sealing ring 562 is sandwiched between the head portion 20 and the inner surface of the eye shield 500 to protect the contact surfaces 540, 542 and contact points 550, 552 from the outside environment.

When the eye shield 500 is mounted to the head portion 20, the forward contact surface 540 continuously, slidingly, electrically engages at least one of the forward electrical contact points 550 throughout the pivotal range of the eye shield 500 relative to the head portion 20. Similarly, the rearward contact surface 542 continuously, slidingly, electrically engages at least one of the rearward electrical contact points 552 throughout the pivotal range of the eye shield 500. Consequently, the heating element 532 is continuously electrically connected to the external power supply jack 560 on the head portion 20 via the electrical connection between the head portion 20 and the eye shield 500 that is defined by the contact surfaces 540, 542 and contact points 550, 552.

Alternatively, the contact surfaces 540, 542 and contact points 550, 552 could be positioned such that the forward contact surface 540 only electrically engages one of the forward electrical contact points 550 when the eye shield 500 is in its lowered position. The same may be true for the rearward contact surface 542 and the rearward contact points 552. Consequently, lowering the eye shield 500 into the lowered position turns on the heating system 530 and raising the eye shield 500 turns off the heating system 530.

Because the power supply lead is adapted to be attached to the head portion 20 instead of directly to the eye shield 500, as is known in conventional eye shield heating systems, the power supply lead cannot act as a tether and apply a raising or lowering force to the eye shield 500. Furthermore, the power supply lead does not interfere with the wearer's operation of the eye shield 500.

As illustrated in FIG. 1, the helmet 10 further includes a mounting bracket 600 for a flashlight or other type of external, removable gear. In FIG. 2, a flashlight 602 is mounted to the mounting bracket 600. The mounting bracket may include electrical contacts similar to the contact points 550, 552 of the eye shield heating system 530. Such contacts would provide electrical power to the flashlight and be electrically connected to the external power supply jack 560.

Additional features may also be provided on the helmet 10. For example, a rear light may be installed on the back side of the head portion 20. The lights are LEDs that are preferably connected to a vehicle power supply in the same manner as the heating system 530.

A communications system may also be installed in the helmet 10 so that the wearer can communicate with the wearer of a second helmet 10 or second communications system. Such a communications system would be particularly advantageous for use by a driver and passenger of a snowmobile.

FIGS. 13–21 illustrate a helmet 700 according to an alternative embodiment of the present invention. Like the helmet 10, the helmet 700 includes a head portion 710 and a jaw shield 720. Also as in the helmet 10, the jaw shield 720 of the helmet 700 included two fixed side portions 730 and a detachable center portion 740.

A separable hinge 750 like the previously described separable hinge 50 selectively connects the detachable portion 740 to the fixed portions 730. Inner sides 760 of the fixed portions 730 are generally planar, but may alternatively be curved, bumped, convex, concave, angled, etc.

Accordingly, as viewed from the front, the inner sides 760 generally form a V shape (as opposed to the generally U shape of the inner sides 48, 49 and pin 47 of the helmet 10). In use, this V-shaped opening generally forms a funnel that guides the detachable portion 740 into alignment with the fixed portions 730 when a wearer attempts to engage the separable pieces (e.g., a C-shaped clip and a pin) of the separable hinge 750.

The helmet 700 includes a breathing mask 770 that is operatively connected to the detachable portion 740 via a mask adjustment mechanism 780. The breathing mask 770 and mask adjustment mechanism 780 are similar to the breathing mask 200 and mask adjustment mechanism 210. Accordingly, a redundant detailed description of the similar or identical features and structures is omitted.

Figure 14:
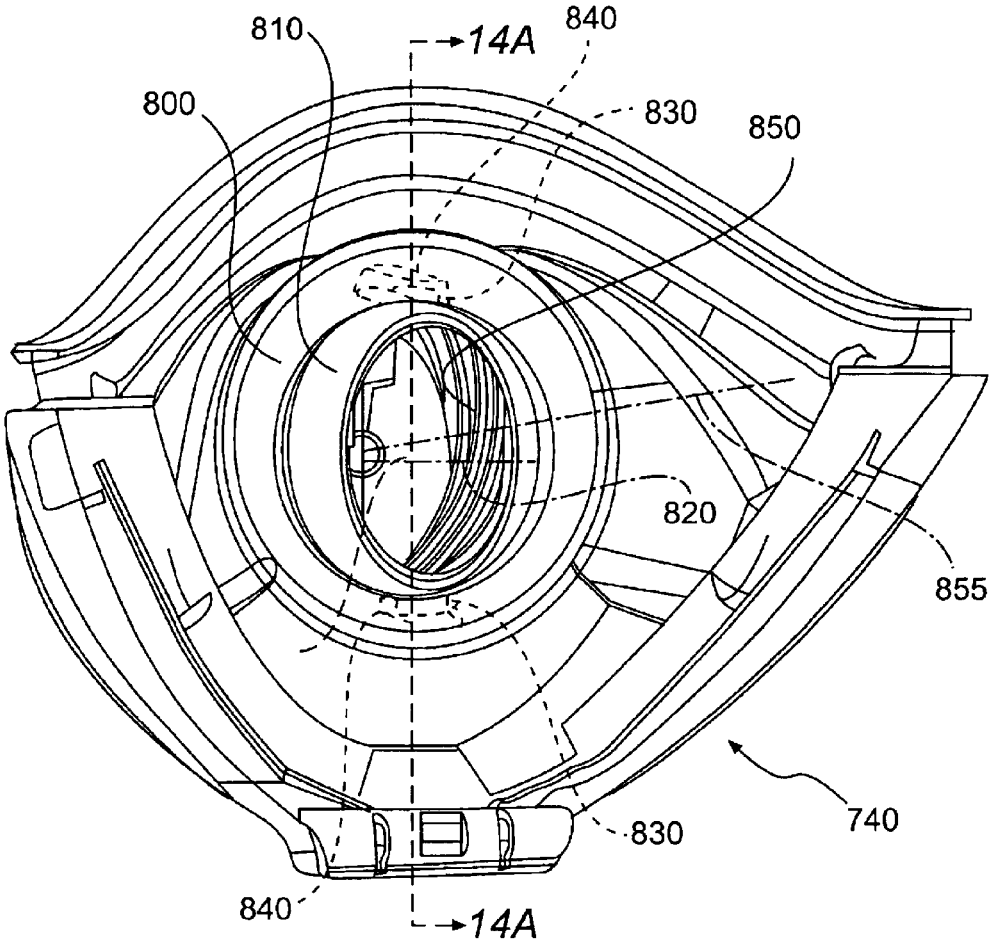
FIG. 14 is a partial perspective view of a detachable jaw shield portion of the helmet of FIG. 13.
Figure 14A:
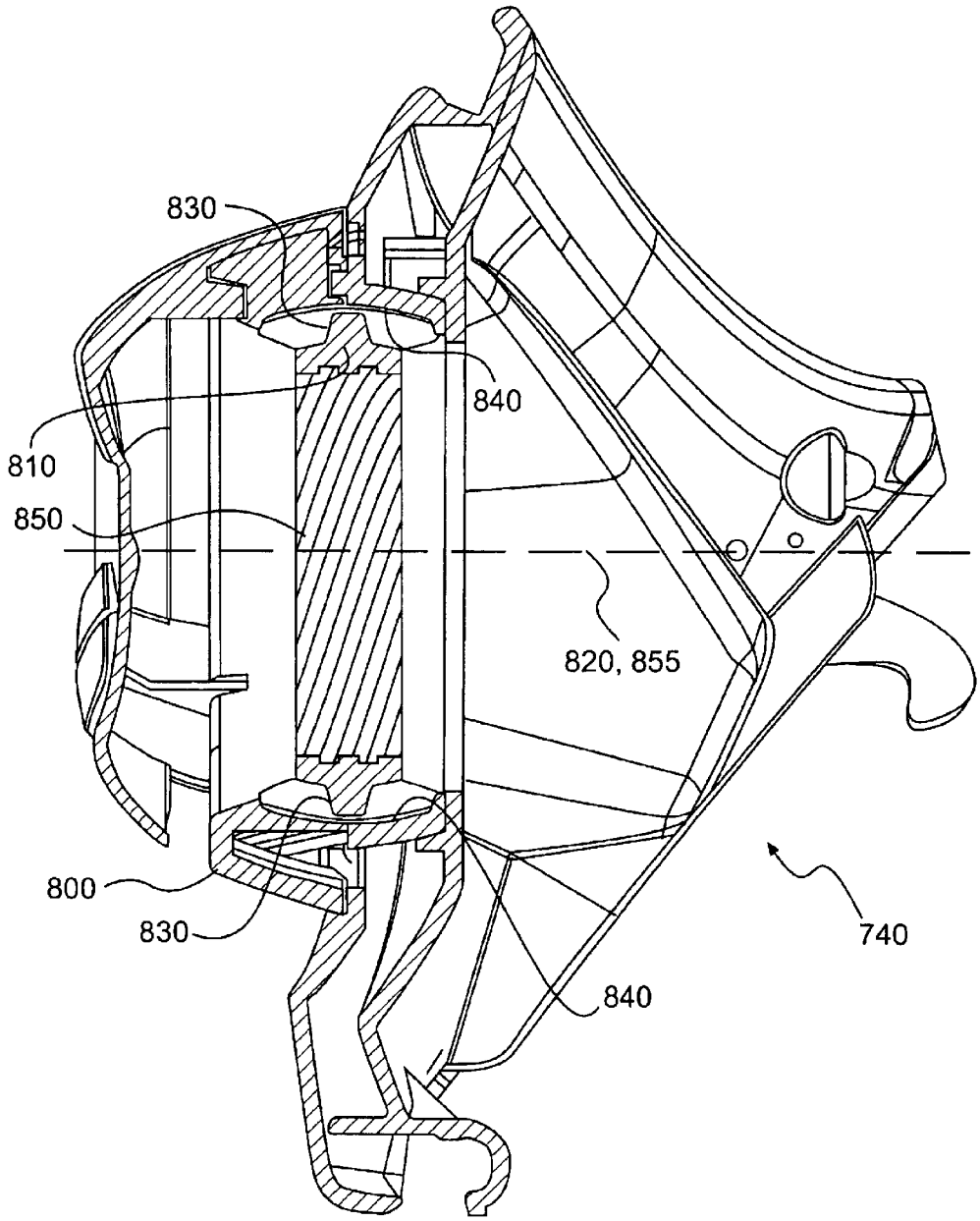
FIG. 14A is a partial cross-sectional view of the detachable jaw shield portion of FIG. 14, taken along the line 14A—14A in FIG. 14.
Figure 15:
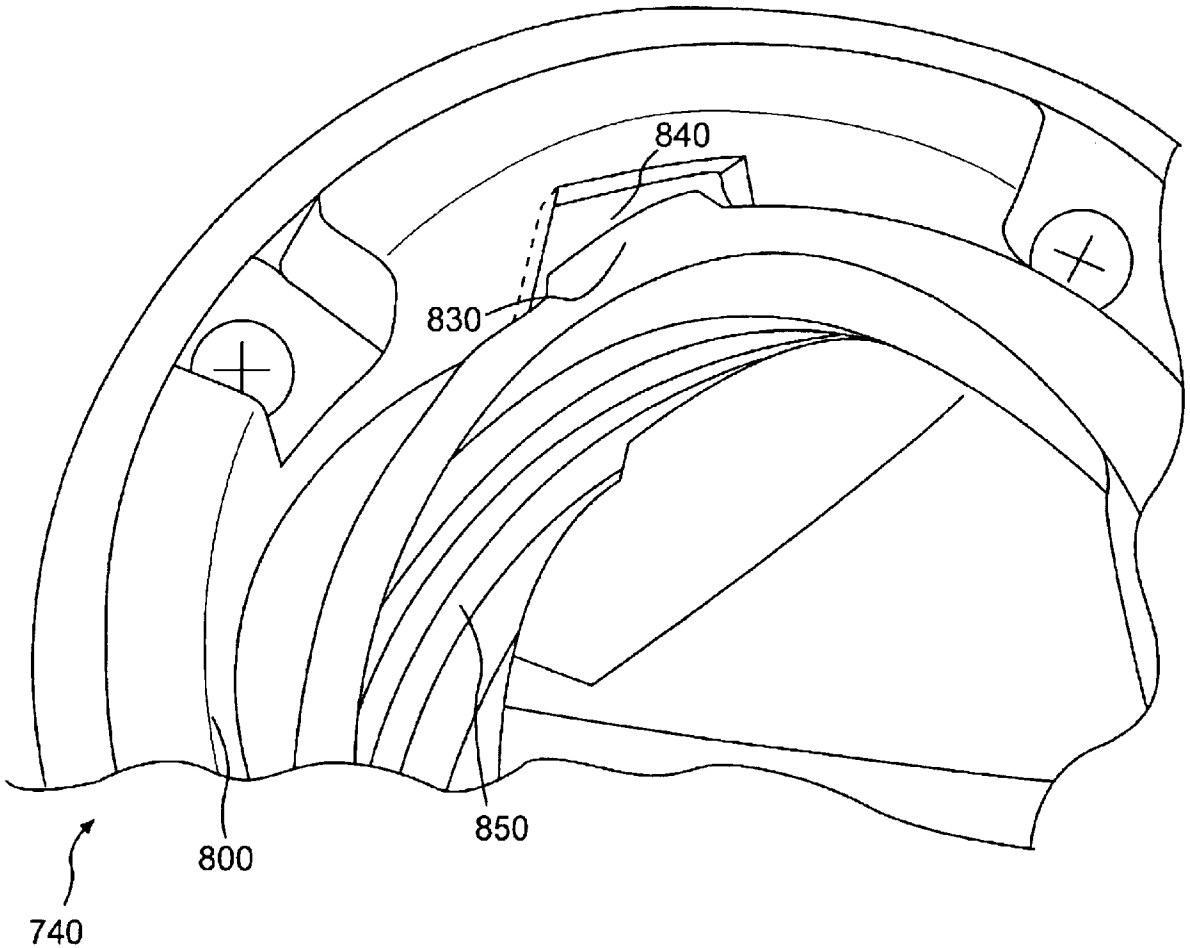
FIG. 15 is a partial perspective view of a detachable jaw shield portion of the helmet of FIG. 13.

As shown in FIGS. 14, 14A, and 15, the mask adjustment mechanism 780 includes a control knob assembly 790 that differs from the control knob 212 of the previously described mask adjustment mechanism 210. The control knob assembly 790 includes a control knob 800 connected to a ring 810. As in the previous embodiment, the control knob 800 is mounted to the detachable portion 740 for relative pivotal movement about a pivot axis 820. However, the control knob 800 cannot move axially along the pivot axis 820 relative to the detachable portion 740. The ring 810 is connected to the control knob 800 in a gimbal fashion that allows the ring 810 to swivel relative to the control knob 800 but ensures that the ring 810 rotates with the control knob 800 about the axis 820. To allow swiveling movement, the ring 810 includes two pivot pins 830 that fit into slots 840 formed inside the control knob 800. The slots 840 allow the pivot pins 830 to slide axially (along the axis 820) to some extent and allow the ring 810 to pivot relative to the control knob 800 about their own axes. An inner circumferential surface of the ring 810 includes threads 850 that mesh with the external threads of an outer axial member (not shown) that is functionally identical to the outer axial member 220 shown in FIGS. 6 and 7. The threads 850 define a second pivot axis 855 that is aligned with the pivot axis 820 when the ring 810 is in a neutral position within the slots 840 but forms an angle with the pivot axis 820 when the ring 810 moves within the slots 840. The gimbal connection between the control knob 8000 and the ring 810 allows the breathing mask 770 to translate slightly up, down, left, and right relative to the jaw shield 720, which allows the breathing mask 770 to be positioned in a greater variety of positions within the helmet 700 than the breathing mask 200 in the previously described embodiment.

As shown in FIGS. 13 and 16–21, the helmet 700 includes an eye shield 900 that is similar to the eye shield 500. The eye shield 900 connects to the head portion of the helmet 700 for relative pivotal movement about an eye shield pivot axis 905. The eye shield 900 includes a heating system 910 that electrically heats the eye shield 900 to discourage water and frost from forming on the eye shield 500 and obstructing the wearer's view. An electric heating element 920, which preferably comprises a thin wire, extends within the space defined between outer and inner layers of the eye shield 900. A bore 930 is formed in one side of the head portion of the helmet 700 and the eye shield 900. The bore is aligned with the eye shield axis 905. Electrically insulated ends 920*a* of the heating element 920 extend inwardly into the helmet 700 through the bore 930. At least a small amount of slack in the insulated ends 920*a* is preferably provided within the bore 930 to ensure that the heating element 920 does not interfere with the pivotal operation of the eye shield 900. Within the helmet 700, the insulated ends 920*a* extend between a hard outer shell of the head portion 710 and a soft internal cushion of the head portion 710 to an electrical power supply jack mounted on the helmet 700. the electrical power supply jack is adapted to be removably electrically connected to an electrical power source such as a snowmobile's battery system. Because the heating element 920 extends through the bore 930 at the axis 905 of the eye shield 900, the heating element 920 does not interfere with the pivotal movement of the eye shield 900. Furthermore, because the connection between the power supply and the heating element 920 does not require the heating element 920 to be disposed on an outside of the eye shield 900, the heating element 920 does not get caught on objects outside the helmet 700.

Figure 13:
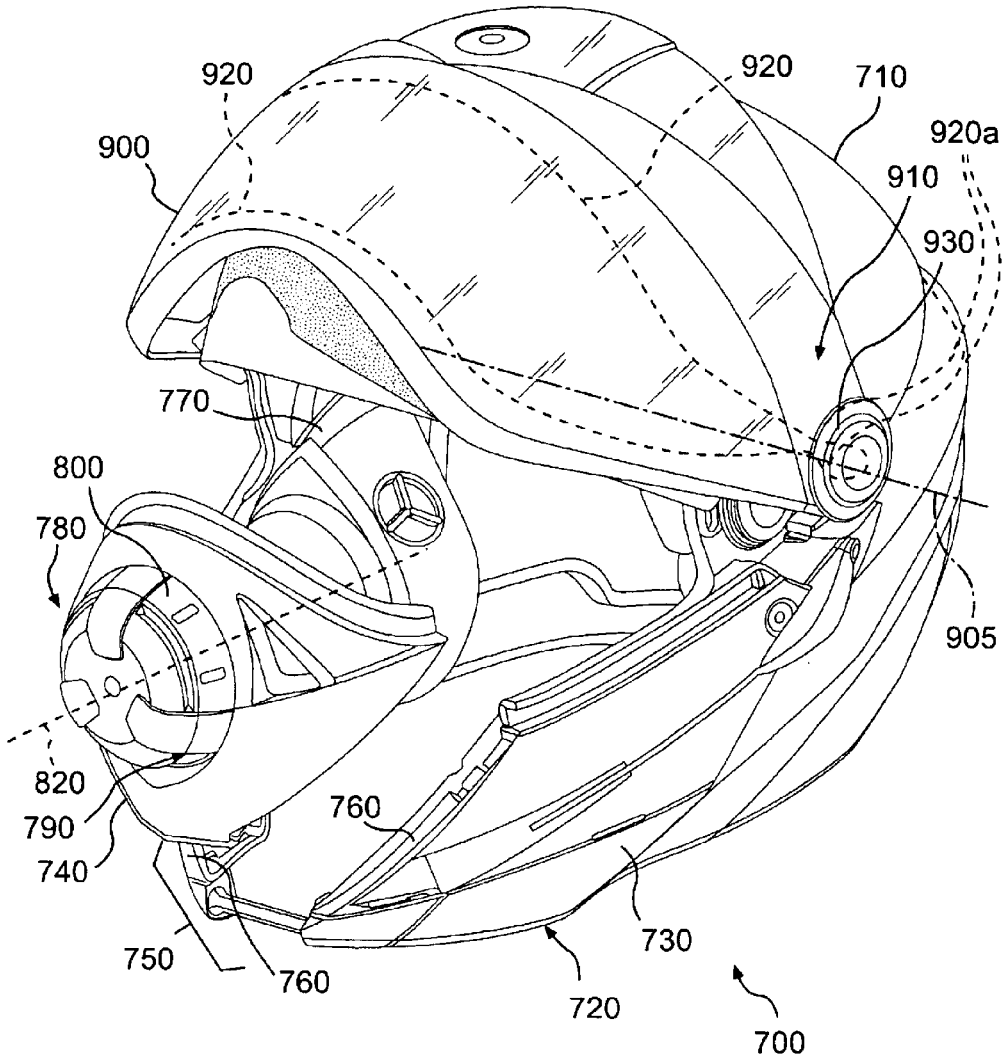
FIG. 13 is a perspective view of a helmet according to an additional embodiment of the present invention.
Figure 16:
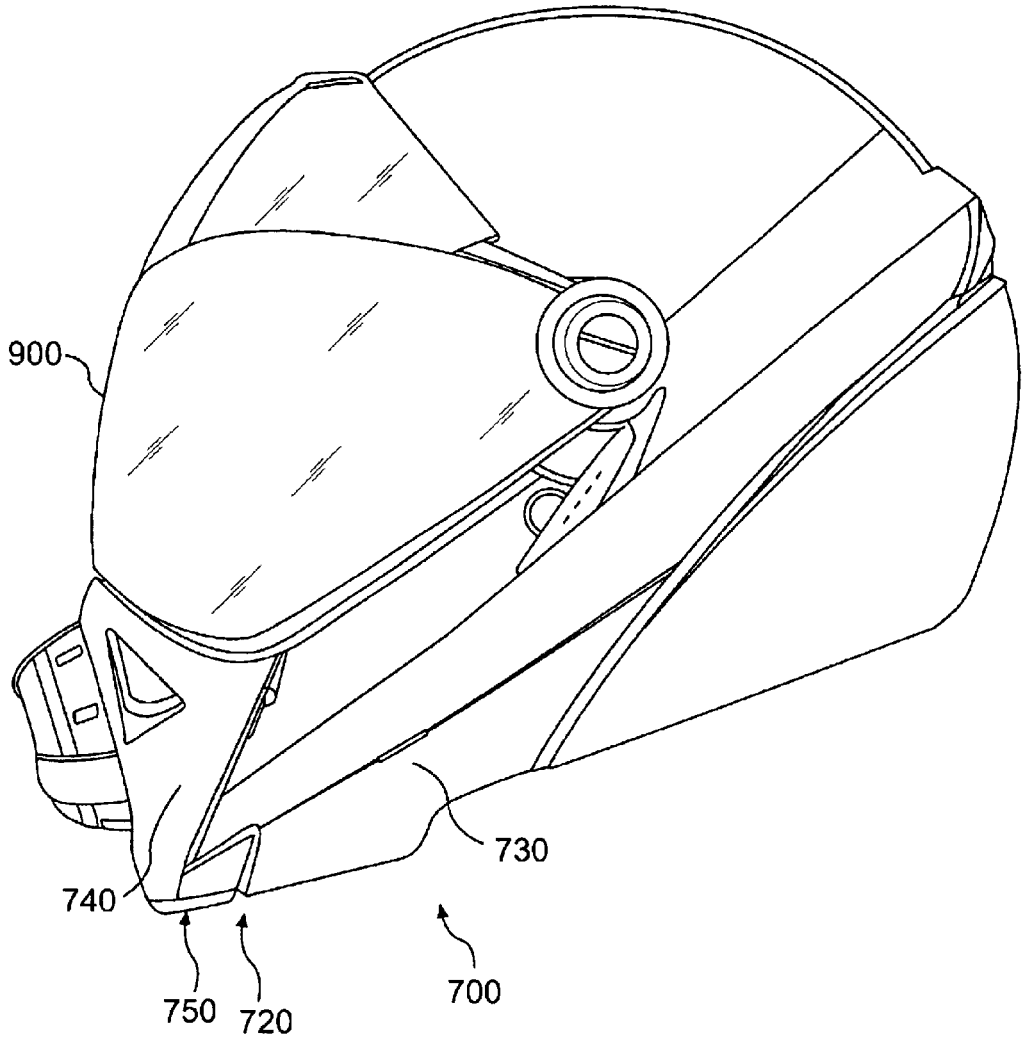
FIG. 16 is a side view of the helmet of FIG. 13 with the detachable jaw shield portion attached and an eye shield in a lowered position.
Figure 17:
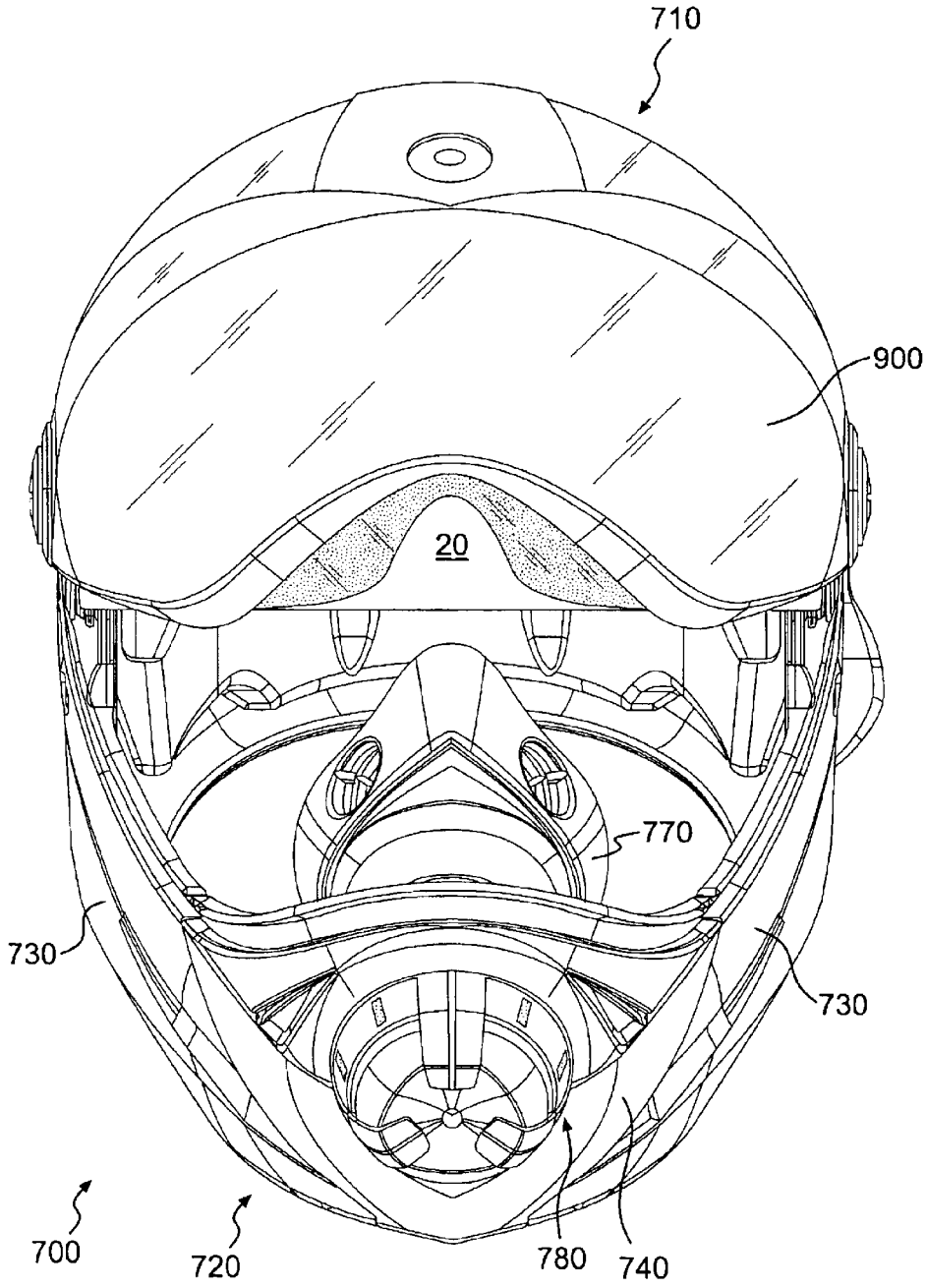
FIG. 17 is a front view of the helmet of FIG. 13 with the detachable jaw shield portion attached and the eye shield in a raised position.
Figure 18:
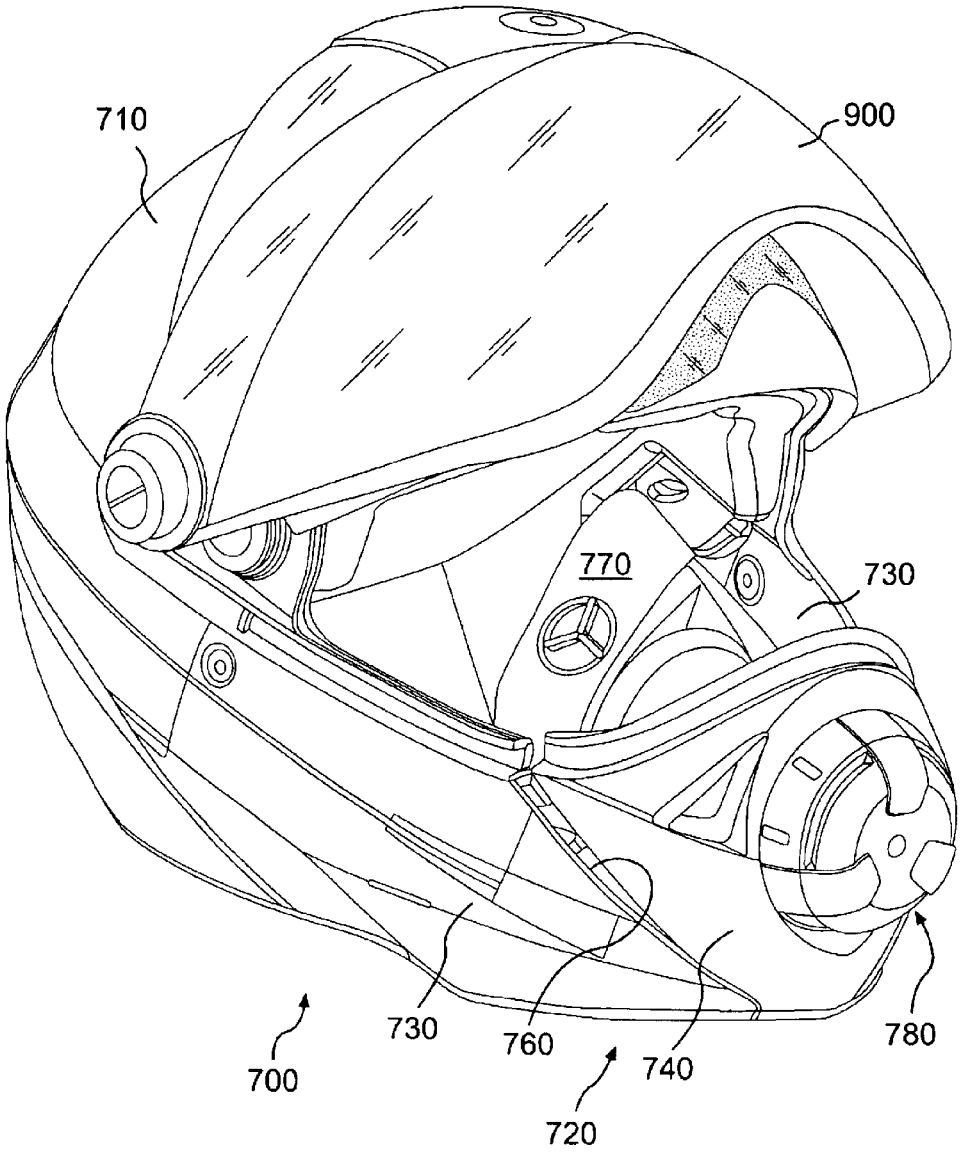
FIG. 18 is a front, right perspective view of the helmet of FIG. 13 with the detachable jaw shield portion mostly attached and the eye shield in the raised position.
Figure 19:
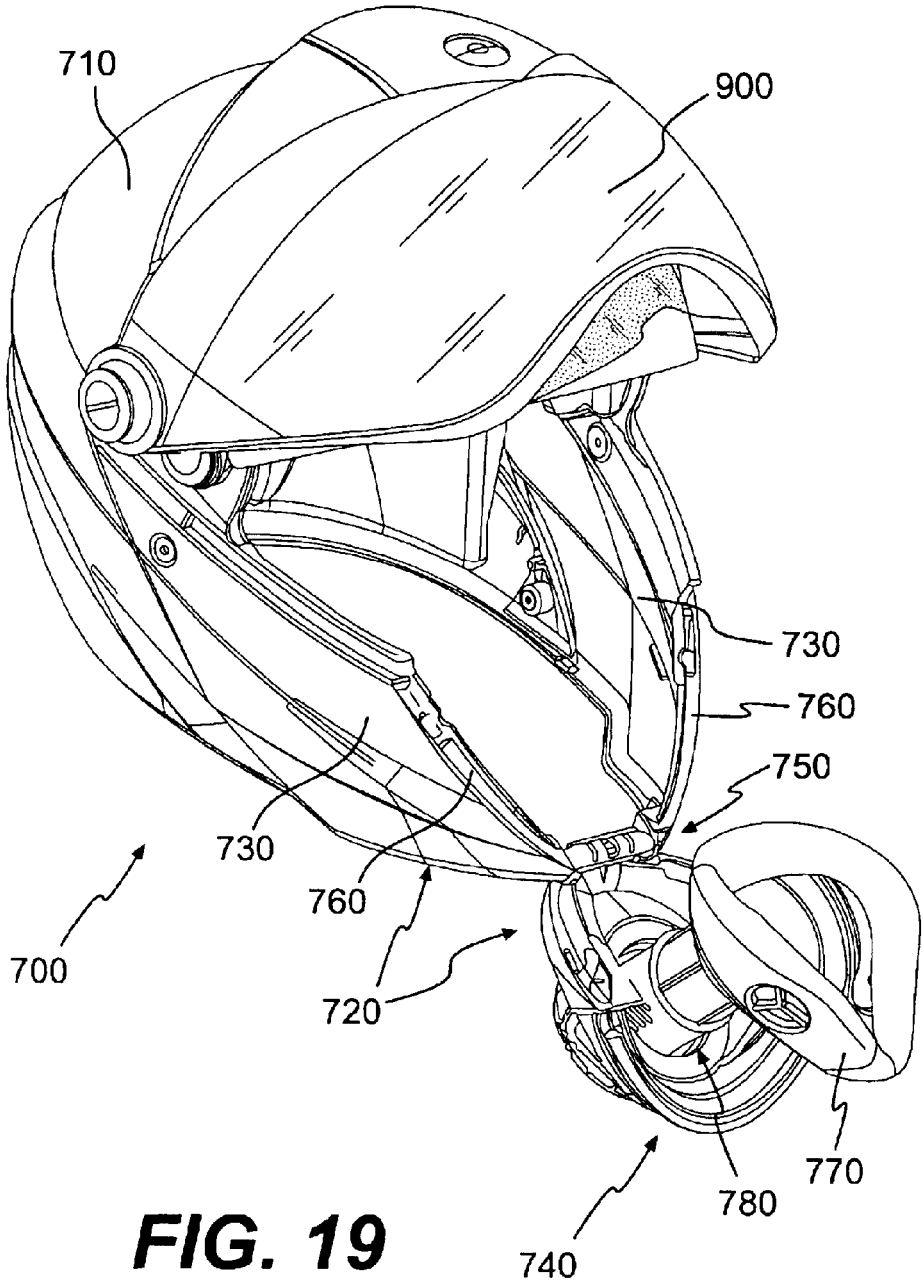
FIG. 19 is a front right perspective of the helmet of FIG. 13 with the detachable jaw shield portion partially attached and the eye shield in the raised position.
Figure 20:
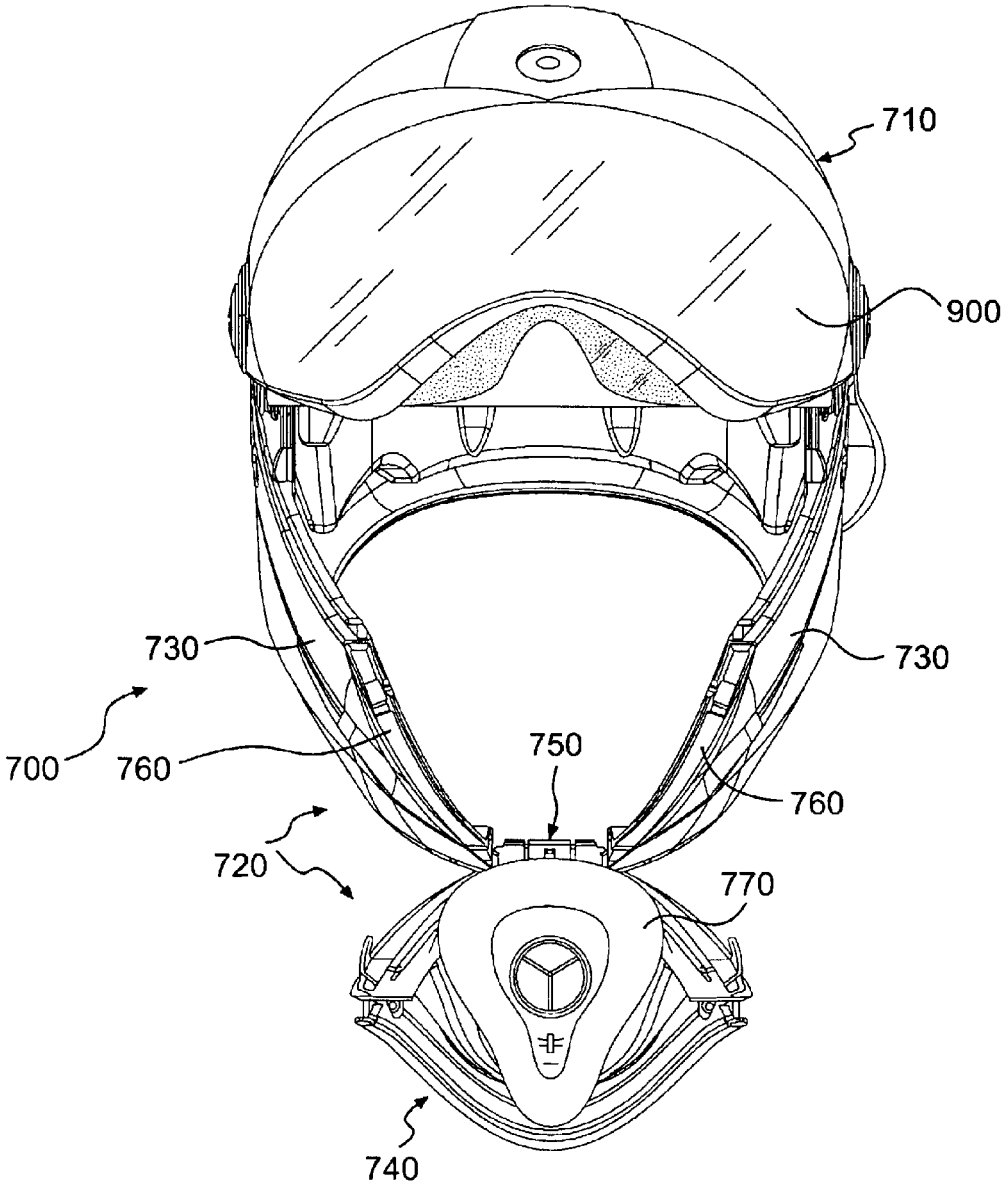
FIG. 20 is a front view of the helmet of FIG. 13 with the detachable jaw shield portion partially attached and the eye shield in the raised position.
Figure 21:
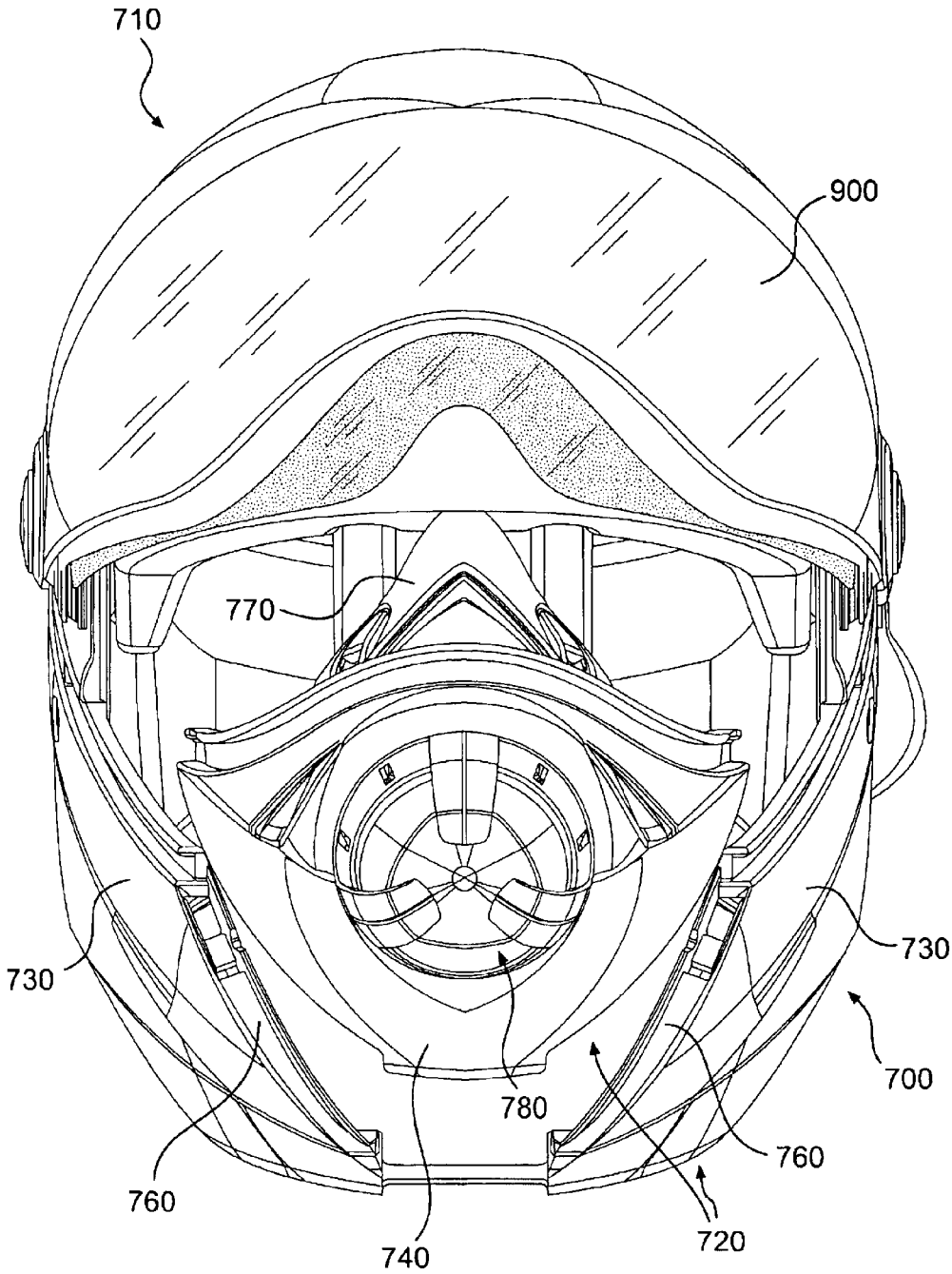
FIG. 21 is a front view of the helmet of FIG. 13 with the detachable jaw shield portion detached and the eye shield in the raised position.
Figure 22:
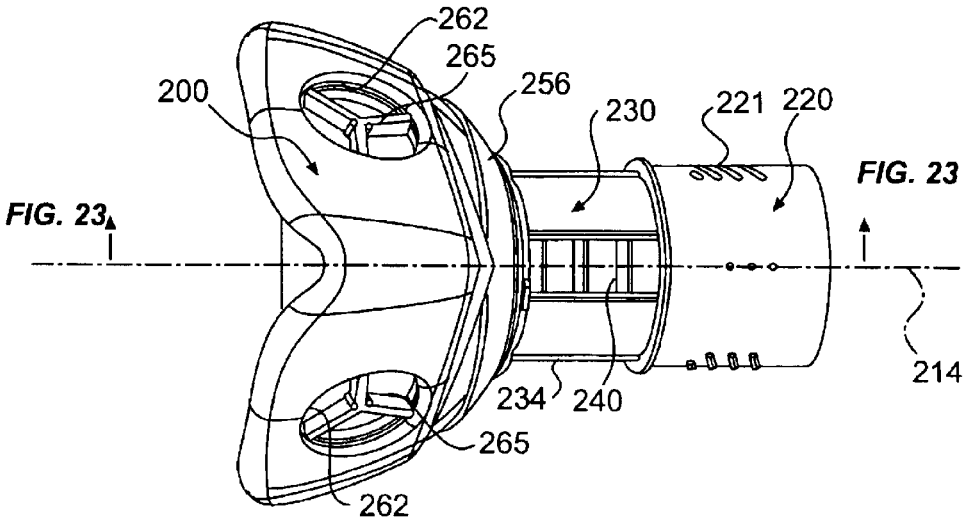
FIG. 22 is a partial top view of a breathing mask and breathing mask adjustment mechanism of the helmet of FIG. 1.

FIGS. 16–21 generally show the progressive detachment of the detachable portion 740 from the helmet 700. In FIG. 16, the detachable portion 740 is attached to the fixed portions 730 and the eye shield 900 is lowered. As illustrated in FIG. 17, the eye shield 900 is then raised. While removing the detachable portion 740 of the illustrated helmet 700 requires the eye shield 900 to be at least partially raised, a helmet according to the present invention may alternatively be designed such that the detachable portion 740 may be removed without raising the eye shield 900. As illustrated in FIG. 18, a latch mechanism like the latch mechanism 52 of the previous embodiment may be released to allow the detachable portion 740 to pivot outwardly away from the fixed portions 730 about the separable hinge 750. As illustrated in FIGS. 19 and 20, the detachable portion 740 may then be pivoted outwardly and downwardly away from the fixed portions 730. As illustrated in FIGS. 13 and 21, the separable hinge 750 may subsequently be completely separated to separate the detachable portion 740 from the fixed portions 730.

Figure 27:
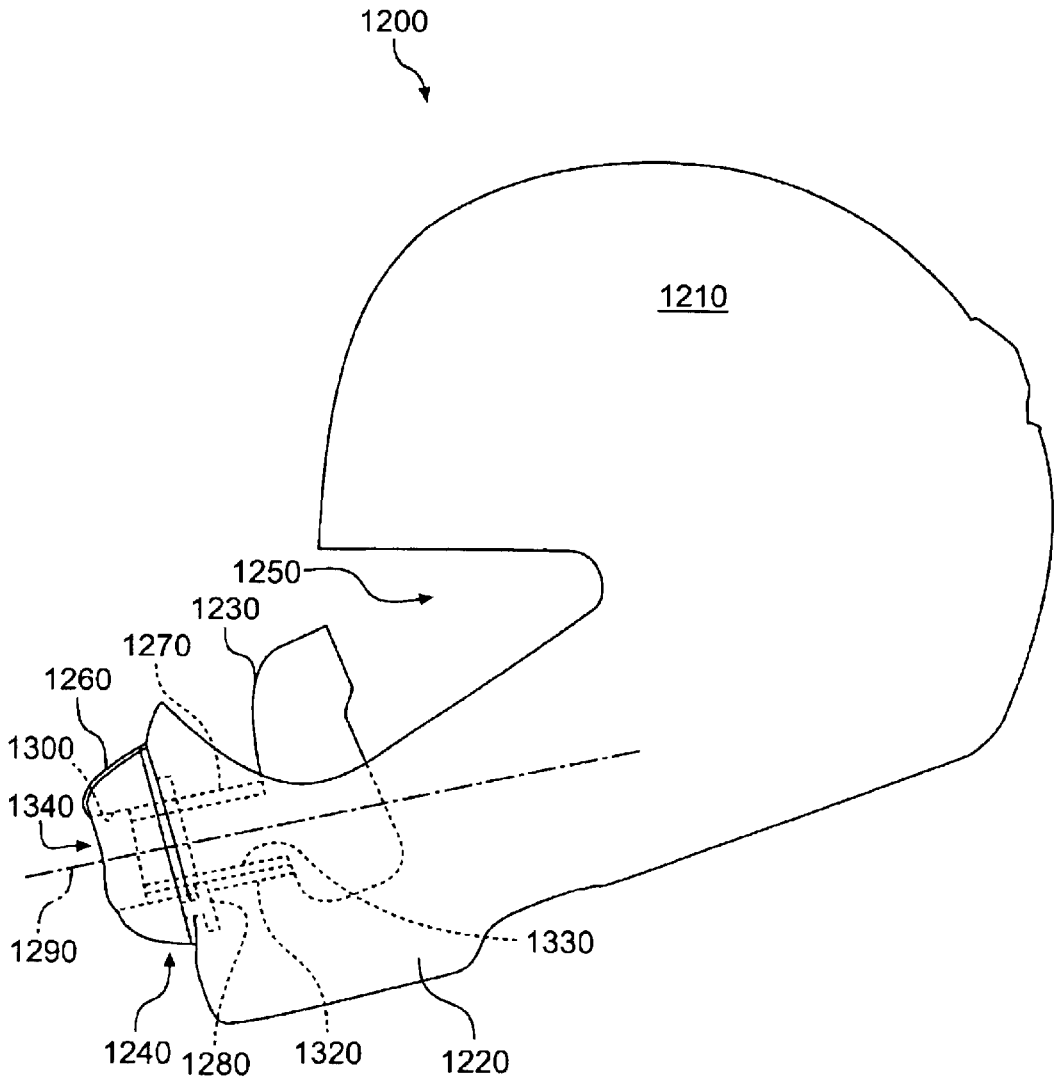
FIG. 27 is a side view of a helmet with a mask adjustment mechanism according to an alternative embodiment of the present invention.
Figure 28:
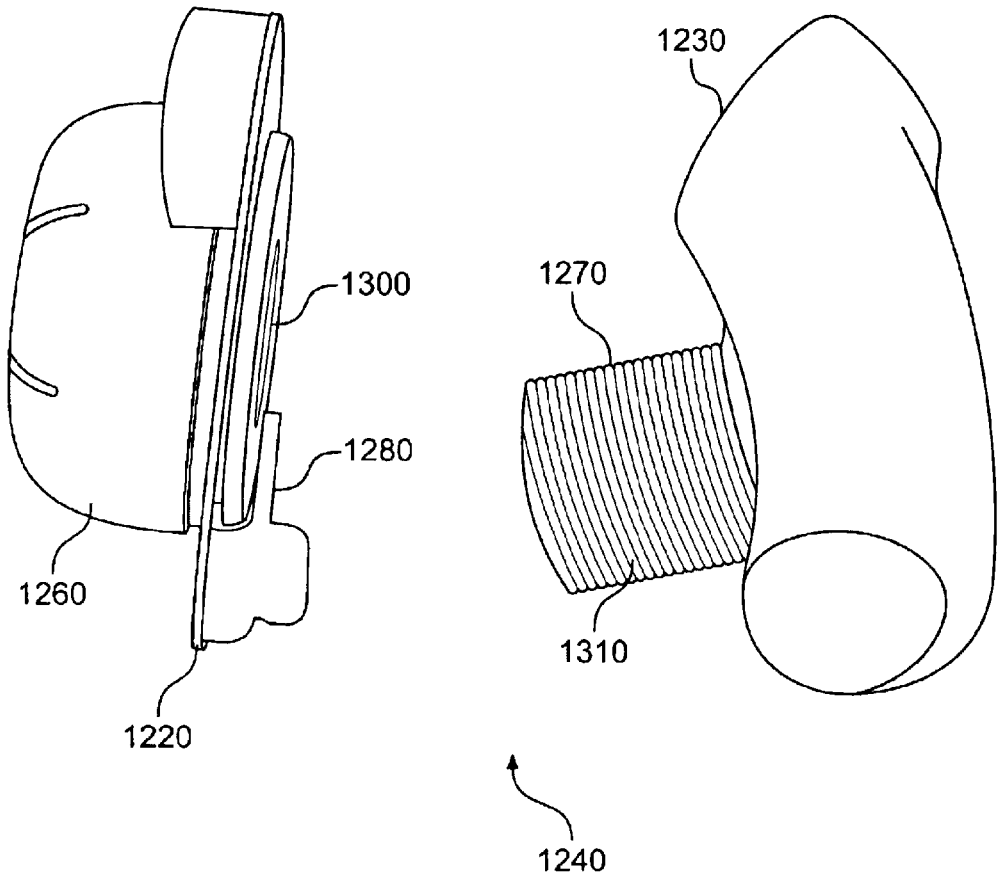
FIG. 28 is a partial exploded side view of the mask adjustment mechanism of FIG. 27.
Figure 29:
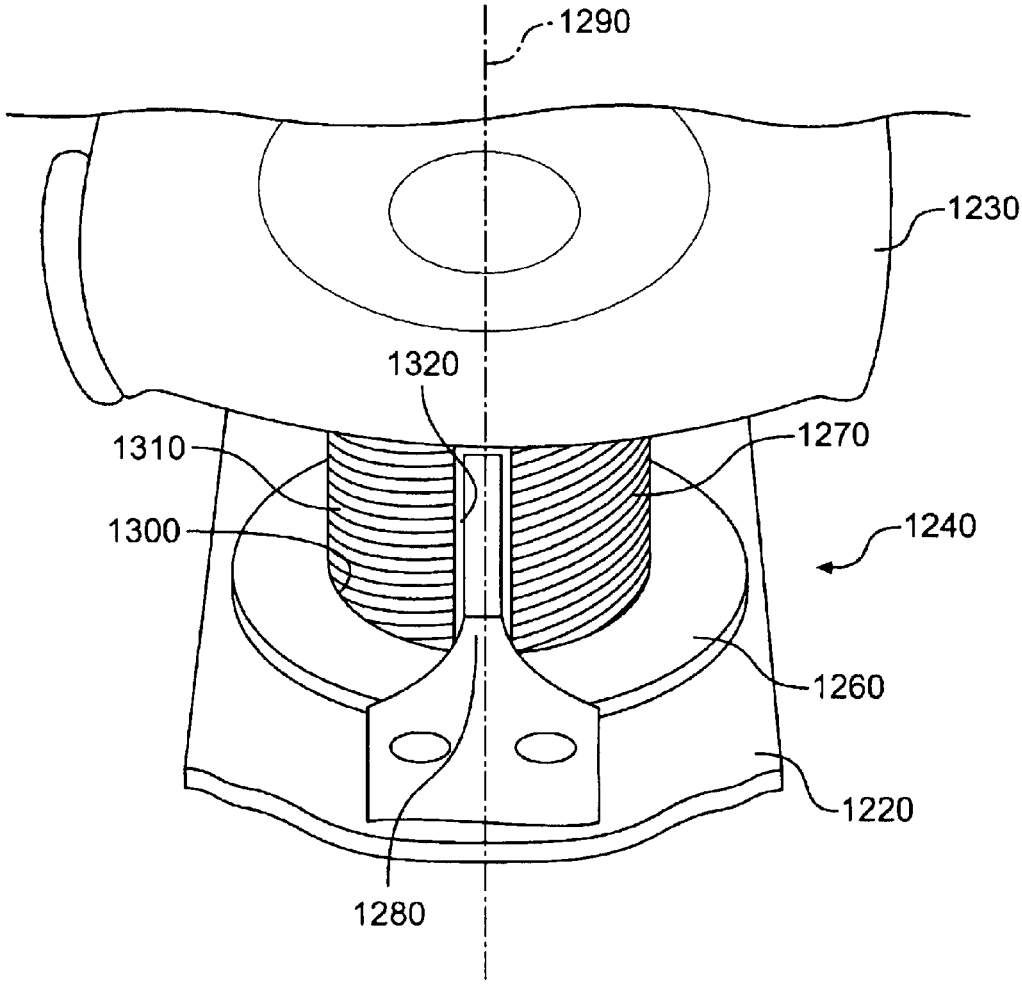
FIG. 29 is a partial perspective view of the mask adjustment mechanism of FIG. 27.

FIGS. 27–29 illustrate a helmet 1200 according to an alternative embodiment of the present invention. To avoid redundant disclosure, an exhaustive description of the elements of the helmet 1200 that are similar to or identical to the previously described embodiments is omitted. As illustrated in FIG. 27, the helmet 1200 includes a head portion 1210, a jaw shield 1220 connected to the head portion 1210, a breathing mask 1230, and a breathing mask adjustment mechanism 1240 operatively connecting the breathing mask 1230 to the jaw shield 1220.

In the illustrated embodiment, the jaw shield 1220 is rigidly connected to (or integrally formed with) the head portion 1210. However, the jaw shield 1220, or a portion of the jaw shield 1220 may alternatively be movably connected to the head portion 1210, as is described above in connection with one or more of the previous embodiments. The head portion 1210 and jaw shield 1220 together define an inner space 1250.

The breathing mask adjustment mechanism 1240 adjustably connects the breathing mask 1230 to the jaw shield 1220 so as to selectively move the breathing mask 1230 within the inner space 1250 (*a*) away from an interior surface of the jaw shield 1220 and toward the mouth and nose of the wearer, and (b) toward the interior surface of the jaw shield 1220 and away from the mouth and nose of the wearer.

As illustrated in FIGS. 28 and 29, the mask adjustment mechanism 1240 comprises a control knob 1260, an axial member 1270, and a retaining key 1280.

The control knob 1260 connects to the jaw shield 1220 for relatively free rotation relative to the jaw shield 1220 about an adjustment mechanism axis 1290 (see FIG. 27). However, the connection between the knob 1260 and the jaw shield 1220 prevents the knob 1260 from moving along the axis 1290 relative to the jaw shield 1220. The knob 1260 includes a central, internally-threaded bore 1300 that is aligned with the axis 1290.

The axial member 1270 includes an externally threaded portion 1310 that is threaded into the internally threaded bore 1300 of the control knob 1260 such that the axial member 1270 is aligned with the axis 1290. The axial member 1270 mounts to the breathing mask 1230 such that the breathing mask moves with the axial member 1270 along the axis 1290.

As illustrated in FIG. 29, an axially extending keyway 1320 is formed in the outer surface of the axial member 1270. The retaining key 1280 mounts to the jaw shield 1220. While the retaining key 1280 is bolted to the jaw shield 1220 in the illustrated embodiment, the retaining key 1280 and jaw shield 1220 may alternatively be connected in any other fashion (for example, integral formation, glue, screws, rivets). When the axial member 1270 is threaded into the bore 1300 of the knob 1260, the retaining key 1280 engages the keyway 1320, which prevents the axial member 1270 from rotating relative to the jaw shield 1220 about the axis 1290. While a keyway 1320 and retaining key 1280 are used in the illustrated embodiment to discourage the axial member 1270 from rotating relative to the jaw shield 1220, a variety of other structures may be used to accomplish this task without deviating from the scope of the present invention. For example, an accordion-folded connector such as the connector 260 illustrated in FIG. 3 and discussed above may be used. Moreover, the adjustment mechanism may alternatively rely on engagement between the wearer's face and the breathing mask to discourage the axial member from rotating relative to the wearer, the helmet, and the jaw shield about the axis 1290.

To adjust the adjustment mechanism 1240, the helmet wearer rotates the control knob 1260 about the axis 1290. The resulting relative rotation of the threads of the bore 1300 and axial member 1270 causes the axial member 1270 and the attached breathing mask 1230 to telescopically move along the axis 1290 relative to the control knob 1260 and the jaw shield 1220. The retaining key 1280 and keyway 1320 ensure that rotation of the control knob 1260 will cause telescopic movement of the breathing mask 1230 by preventing the axial member 1270 from rotating with the control knob 1260 about the axis 1290. The wearer can therefore use the control knob 1260 and adjustment mechanism 1240 to snugly fit the breathing mask 1230 against his/her mouth and nose.

The axial member 1270 defines an axially extending opening 1330 that fluidly connects the breathing space within the breathing mask 1230 to the bore 1300. Together, the bore 1300 and the opening 1330 define an exhaust air passageway 1340 that fluidly connects the breathing space within the breathing mask 1230 to the ambient environment outside the helmet 1200. The exhaust air passageway 1340 is generally aligned with the axis 1290 and is positioned such that it extends downwardly and forwardly as it progresses away from the mouth and nose of the wearer when the wearer wears the helmet 1200.

The foregoing illustrated embodiments are provided to illustrate the structural and functional principles of the present invention and are not intended to be limiting. To the contrary, the principles of the present invention are intended to encompass any and all changes, alterations and/or substitutions within the spirit and scope of the following claims.

What is claimed is:

1. A helmet comprising:

a head portion;

an eye shield connected to the head portion for relative movement between a raised position wherein the eye shield is substantially out of a wearer's field of vision and at least one lowered position wherein the eye shield is disposed in front of the wearer's eyes;

a tinted shield behind the eye shield, the tinted shield being connected to the head portion and being moveable between a raised position wherein the tinted shield is substantially out of the wearer's field of vision and at least one lowered position wherein the tinted shield is disposed in front of the wearer's eyes; and a resilient member connected between the head portion and the tinted shield, the resilient member biasing the tinted shield toward the raised position.

2. The helmet of claim 1, further comprising a holding device operatively connecting the eye shield to the tinted shield, the holding device selectively preventing the tinted shield from moving from the lowered position to the raised position when the tinted shield and the eye shield are in the lowered positions.

3. A helmet according to claim 2, wherein the holding device further comprises:

a lever connected to the holding device, the lever being displaceable in lowering and raising directions, the lever moving the tinted shield into a lowered position when the lever is moved in the lowering direction.

4. The helmet of claim 3, wherein the lever is adapted to disengage the holding device from the eye shield when the eye shield and the tinted shield are in the lowered position, thereby allowing the tinted shield to move into the raised position when the lever is moved in the raising direction.

5. A helmet according to claim 4, wherein the tinted shield is connected to the head portion for pivotal movement about a first axis.

6. A helmet according to claim 5, wherein the eye shield is connected to the head portion for pivotal movement about a second axis.

7. The helmet of claim 5, wherein the lever is flexible along a direction of the first axis.

8. The helmet of claim 7, wherein the eye shield comprises a block mounted on an inside surface thereof, wherein the block abuts the lever when the eye shield and the tinted shield are in the lowered position thus preventing the tinted shield from returning to the raised position.

9. A helmet comprising:

a head portion;

an eye shield connected to the head portion moveable between a raised position where the eye shield is substantially out of a wearer's field of vision and at least one lowered position where the eye shield is disposed in front of the wearer's eyes;

a tinted shield behind the eye shield, the tinted shield being connected to the head portion and being moveable between a raised position where the tinted shield is substantially out of the wearer's field of vision and at least one lowered position where the tinted shield is disposed in front of the wearer's eyes;

a first resilient member connected between the head portion and the tinted shield, the first resilient member biasing the tinted shield toward the raised position; and a holding device disposed between the head portion and the tinted shield, the holding device selectively preventing relative movement between the tinted shield and the head portion when the tinted shield is in a lowered position.

10. A helmet according to claim 9, further comprising:

a lever connected to the head portion, the lever being displaceable in lowering and raising directions, the lever releasing the holding device thereby allowing the tinted shield to move into the raised position when the lever is moved in the raising direction, the lever engaging the tinted shield and moving the tinted shield into a lowered position when the lever is moved in the lowering direction.

11. A helmet according to claim 10, wherein the tinted shield is connected to the head portion for pivotal movement about a first axis.

12. A helmet according to claim 11, wherein the lever is connected to the head portion for pivotal movement between the raising and lowering directions about a second axis that is offset from the first axis.

13. A helmet according to claim 9, wherein the holding device comprises:

a first at least one tooth mounted to the tinted shield; and a second at least one tooth mounted to the head portion, the first at least one tooth and second at least one tooth being positioned to engage each other when the tinted shield is moved into the lowered position, thereby discouraging the tinted shield from moving into the raised position under the biasing force of the first resilient member.

14. A helmet according to claim 13, wherein the first at least one tooth comprises a first plurality of teeth, wherein the second at least one tooth comprises a second plurality of teeth, and wherein the tinted shield has a plurality of lowered positions corresponding to one of each of the first and second plurality of teeth.

15. A helmet according to claim 13, further comprising:

a lever connected to the head portion, the lever being displaceable in lowering and raising directions, the lever releasing the first at least one tooth from the second at least one tooth thereby allowing the tinted shield to move into the raised position when the lever is moved in the raising direction, the lever engaging the tinted shield and moving the tinted shield into a lowered position when the lever is moved in the lowering direction.

16. A helmet according to claim 15, further comprising a second resilient member connected between the lever and the head portion, the second resilient member biasing the lever in a neutral position.

17. A helmet according the claim 16, wherein the lever further includes a lowering hole, and the tinted shield further includes a lowering protrusion which engages with the lowering hole when the lever is moved in the lowering direction to move the tinted shield into a lowered position.

18. A helmet according to claim 17, wherein the lever further includes a raising wedge which releases the first at least one tooth from the second at least one tooth when the lever is moved in the raising direction.

19. A helmet according to claim 17, wherein the lever further includes a handle, whereby the handle is pulled to rotate the lever altering the position of the lowering hole thus causing the lowering hole to engage the lowering protrusion pulling the tinted shield toward the lowered position, and whereby the handle is pushed to rotate the lever, which forces the raising wedge between the first at least one tooth and the second at least one tooth to allow the tinted shield to rotate toward a raised position under the force of the first resilient member.

20. A helmet according to claim 18, wherein the lever further includes a handle, whereby the handle is pulled to rotate the lever altering the position of the lowering hole thus causing the lowering hole to engage the lowering protrusion pulling the tinted shield toward the lowered position, and whereby the handle is pushed to rotate the lever, which forces the raising wedge between the first at least one tooth and the second at least one tooth to allow the tinted shield to rotate toward a raised position under the force of the first resilient member.

21. A helmet according to claim 15, wherein the tinted shield is connected to the head portion for pivotal movement about a first axis.

22. A helmet according to claim 21, wherein the lever is connected to the head portion for pivotal movement between the raising and lowering directions about a second axis that is offset from the first axis.

23. A helmet according to claim 9, wherein the helmet further includes a bumper which cushions the impact force of the raising tinted shield when the tinted shield is thrust upwardly under the biasing force of the first resilient member.

24. A helmet according to claim 20, wherein the helmet further includes a bumper which cushions the impact force of the raising tinted shield when the tinted shield is thrust upwardly under the biasing force of the first resilient member.

25. A helmet according to claim 20, wherein the lowering hole comprises a lowering edge such that the lowering edge does not contact the lowering protrusion when the lever is pushed to rotate the lever which forces the raising wedge between the first at least one tooth and the second at least one tooth to allow the tinted shield to rotate toward a raised position under the force of the first resilient member.

26. A helmet according to claim 19, wherein the helmet further includes a right side and a left side, the handle being placed on one of the right side and the left side of the helmet.

27. A helmet according to claim 26, wherein the handle is adapted to be grasped by one hand of a user wearing the helmet.

* * * * *